US012745846B2

(12) United States Patent
Parsa

(10) Patent No.: US 12,745,846 B2
(45) Date of Patent: Sep. 29, 2026

(54) MODULAR SEATING SYSTEM

(71) Applicant: Benjamin Parsa, Placerville, CA (US)

(72) Inventor: Benjamin Parsa, Placerville, CA (US)

( * ) Notice: Subject to any disclaimer, the term of this patent is extended or adjusted under 35 U.S.C. 154(b) by 91 days.

(21) Appl. No.: 18/926,989

(22) Filed: Oct. 25, 2024

(65) Prior Publication Data

US 2026/0114624 A1 Apr. 30, 2026

(51) Int. Cl.

| | |
|---|---|
| ***A47C 4/42*** | (2006.01) |
| ***A47C 4/02*** | (2006.01) |
| *A47D 1/02* | (2006.01) |
| *A47D 13/06* | (2006.01) |

(52) U.S. Cl.

CPC ..... *A47C 4/42* (2013.01); *A47C 4/022* (2013.01); *A47D 1/02* (2013.01); *A47D 13/063* (2013.01)

(58) Field of Classification Search

CPC ..... A47D 13/063; A47D 1/02; A47C 4/42; A47C 4/022; A47C 4/286

See application file for complete search history.

(56) References Cited

U.S. PATENT DOCUMENTS

| | | | |
|---|---|---|---|
| 665,299 | A | 1/1901 | Wood |
| 2,597,860 | A | 5/1952 | Gerber et al. |
| 2,889,561 | A | 6/1959 | Martin |
| 3,030,146 | A | 4/1962 | Faxon |
| 3,658,382 | A | 4/1972 | Anderson |
| 3,866,976 | A | 2/1975 | Ohlsson |
| 5,738,414 | A | 4/1998 | Wieland et al. |
| 6,017,093 | A | 1/2000 | Moser |
| 6,382,729 | B1 * | 5/2002 | Wu ..... A47C 7/425 297/16.2 |
| 6,839,950 | B2 | 1/2005 | Guillot |
| 6,925,664 | B1 | 8/2005 | Twigg |
| 6,942,298 | B2 | 9/2005 | Harrison |
| 6,981,747 | B2 | 1/2006 | Wieland et al. |
| 7,020,911 | B2 | 4/2006 | Oldham |
| 7,252,273 | B2 | 8/2007 | Lewellen et al. |
| 8,764,114 | B1 | 7/2014 | Frank et al. |
| 9,668,581 | B1 | 6/2017 | Hill |
| 11,109,685 | B1 | 9/2021 | Yang |
| D951,664 | S | 5/2022 | Song |
| 2008/0185897 | A1 | 8/2008 | Griggs |

(Continued)

OTHER PUBLICATIONS

International Search Report and Written Opinion of the International Searching Authority for PCT/US2025/052385 established by the ISA/US completed on Jan. 13, 2026.

*Primary Examiner* — Syed A Islam

(74) *Attorney, Agent, or Firm* — Goldstein Law Offices, P.C.

(57) ABSTRACT

A seating module, having a frame having four rectangular corners. Upper and lower attachment connectors are located at each corner and are connected by a pair of horizontal supports in a scissor configuration. Brace bars extend between the upper attachment connectors at adjacent corners and deck supports extend between diagonal corners. A deck pad is secured on top of the brace bars. In some embodiments, the frame includes one or more cross bars extending above the deck pad to provide armless, corner, or armchair seating units. A fully washable duvet cover is secured over the frame. A decorative cover is secured over the duvet cover and is topped with cushions or pillows as appropriate for the seating module.

8 Claims, 26 Drawing Sheets

(56) References Cited

U.S. PATENT DOCUMENTS

| | | | |
|---|---|---|---|
| 2016/0174715 | A1 | 6/2016 | Nelson et al. |
| 2020/0187654 | A1 | 6/2020 | Mutyala |
| 2021/0169229 | A1 | 6/2021 | Niemela et al. |

* cited by examiner

MODULAR SEATING SYSTEM

TECHNICAL FIELD

The present disclosure relates generally to a modular seating system. More particularly, the present disclosure relates to a system for efficiently constructing seating units that may be used together to create sectional couch type seating systems.

BACKGROUND

Traditionally, furniture was fully constructed in factories and workshops by craftsmen and workers, prior to being delivered to the end user. In the past century, however, furniture products have evolved in a way that allows them to be partially or fully assembled at their ultimate destination.

In recent decades, as furniture is sold less and less through retail channels, and increasingly through ecommerce, the need has increased to minimize package size. At the same time, consumers demand easy to assemble furniture.

Traditional upholstered furniture is difficult to clean. Since the fabric is an integrated part of the furniture, it must be cleaned in place. Spills get trapped within the fabric and cushions, which can be unsightly, and cause odors.

In recent decades various attempts have been made to create furniture that is protected from stains, and easy to assemble on site. While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a seating unit that is easy to clean. Accordingly, the present disclosure provides a seating system wherein the fabric covering is entirely removable and washable.

It is another aspect of an example embodiment in the present disclosure to provide a seating unit that may be efficiently shipped to its intended destination and easily assembled thereat. Accordingly, the frame of the seating unit is constructed from components that are flat, or nearly flat. And may easily assemble into a full-sized seating unit having significant strength and durability.

Accordingly, the present disclosure describes a seating module, having a frame having four rectangular corners. Upper and lower attachment connectors are located at each corner and are connected by a pair of horizontal supports in a scissor configuration. Brace bars extend between the upper attachment connectors at adjacent corners and deck supports extend between diagonal corners. A deck pad is secured on top of the brace bars. In some embodiments, the frame includes one or more cross bars extending above the deck pad to provide armless, corner, or armchair seating units. A fully washable duvet cover is secured over the frame. A decorative cover is secured over the duvet cover and is topped with cushions or pillows as appropriate for the seating module.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
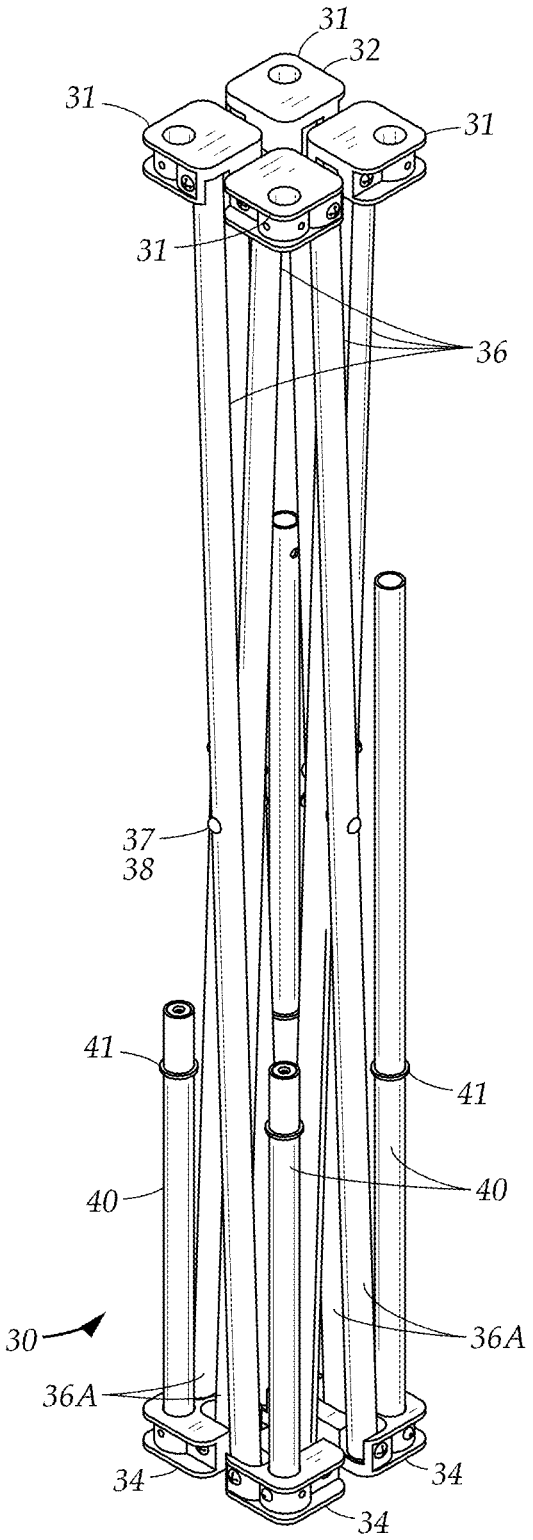
FIG. 1 is diagrammatic perspective view, illustrating a primary frame in a compact, folded position.
Figure 2:
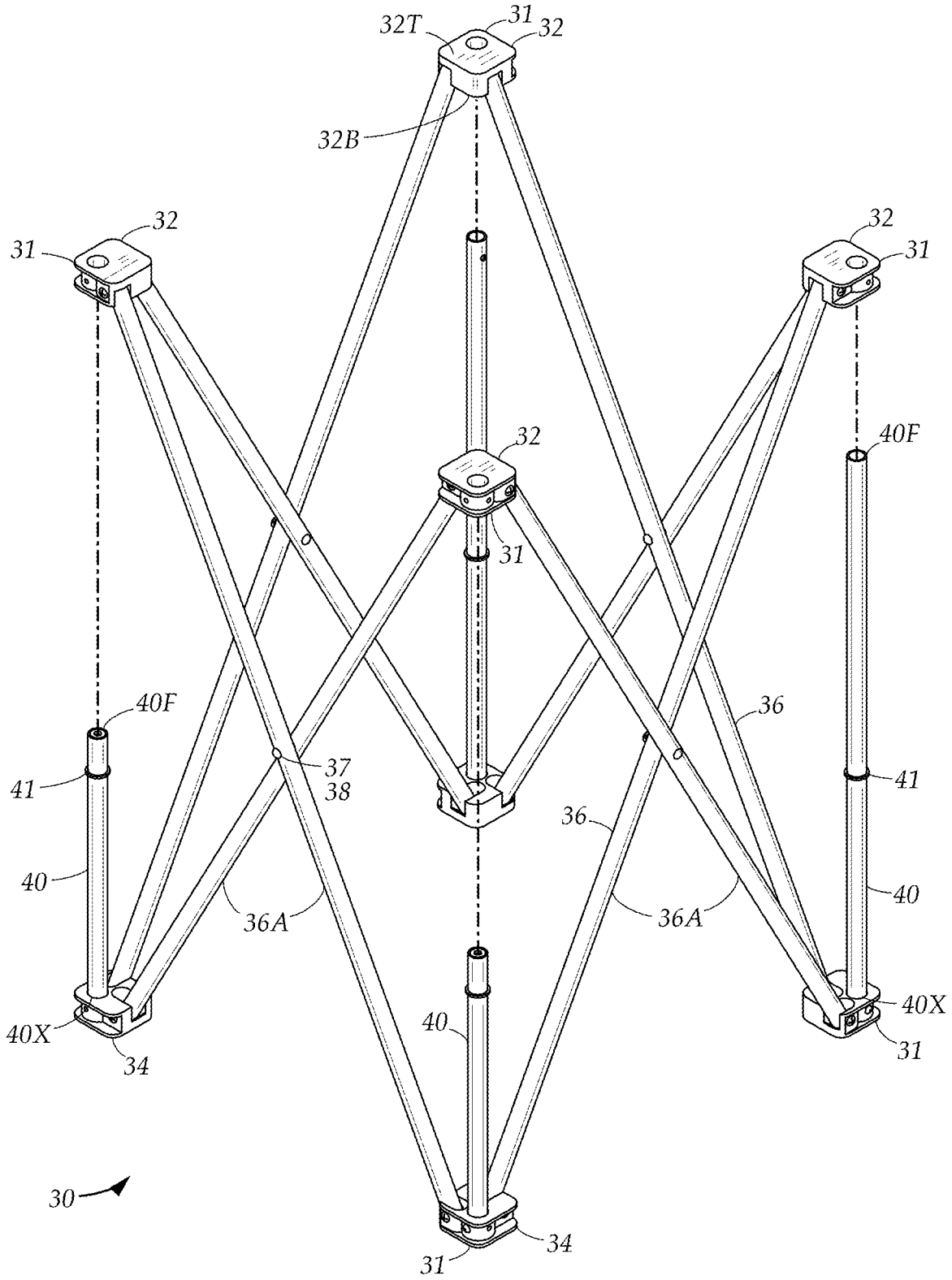
FIG. 2 is a diagrammatic perspective view, illustrating the primary frame, as it is being unfolded.

FIG. 1 illustrates a primary frame 30, in a folded position. The primary frame 30 has a generally rectangular footprint, having four corners 31, that includes diagonal corners, and adjacent corners. Note that in the non-limiting example shown in the drawing figures, the rectangular footprint is actually square. FIG. 2 illustrates the primary frame 30 in a partially unfolded position. Viewing FIG. 1 and FIG. 2 together, the primary frame 30 includes four upper attachment connectors 32, each having a top surface 32T and a bottom surface 32B, and four lower attachment connectors 34. Each of the upper attachment connectors 32 and lower attachment connectors 34 are located at one of the corners 31 and are vertically aligned. Four pairs 36A of horizontal supports 36 each extend between one of the corners 31 and another of the corners 31 that is adjacent to said one of the corners. At each corner 31, one of the horizontal supports 36 from one of the pairs of horizontal supports 36A extend the lower attachment connector 34 at that corner 31 to the upper attachment connector 32 at the adjacent corner 31. The other of the horizontal supports 36 from said pair extends from the upper attachment connector 32 at said corner 31 to the lower attachment connector 34 at said adjacent corner 31. The horizontal supports 36 in each pair 36A meet midway at a pivot point 37 in a scissor arrangement, where they can pivot with respect to each other upon a pivot pin 38. A vertical mast 40 extends upwardly from each of the lower attachment connectors 34, each vertical mast 40 is fixed in a vertical position to said lower attachment connector 34, extending upwardly from said lower attachment connector 34. Each vertical mast 40 has a fixed end 40X, a free end 40F, and has a flange 41 between the fixed end 40X and free end 40F.

Figure 3:
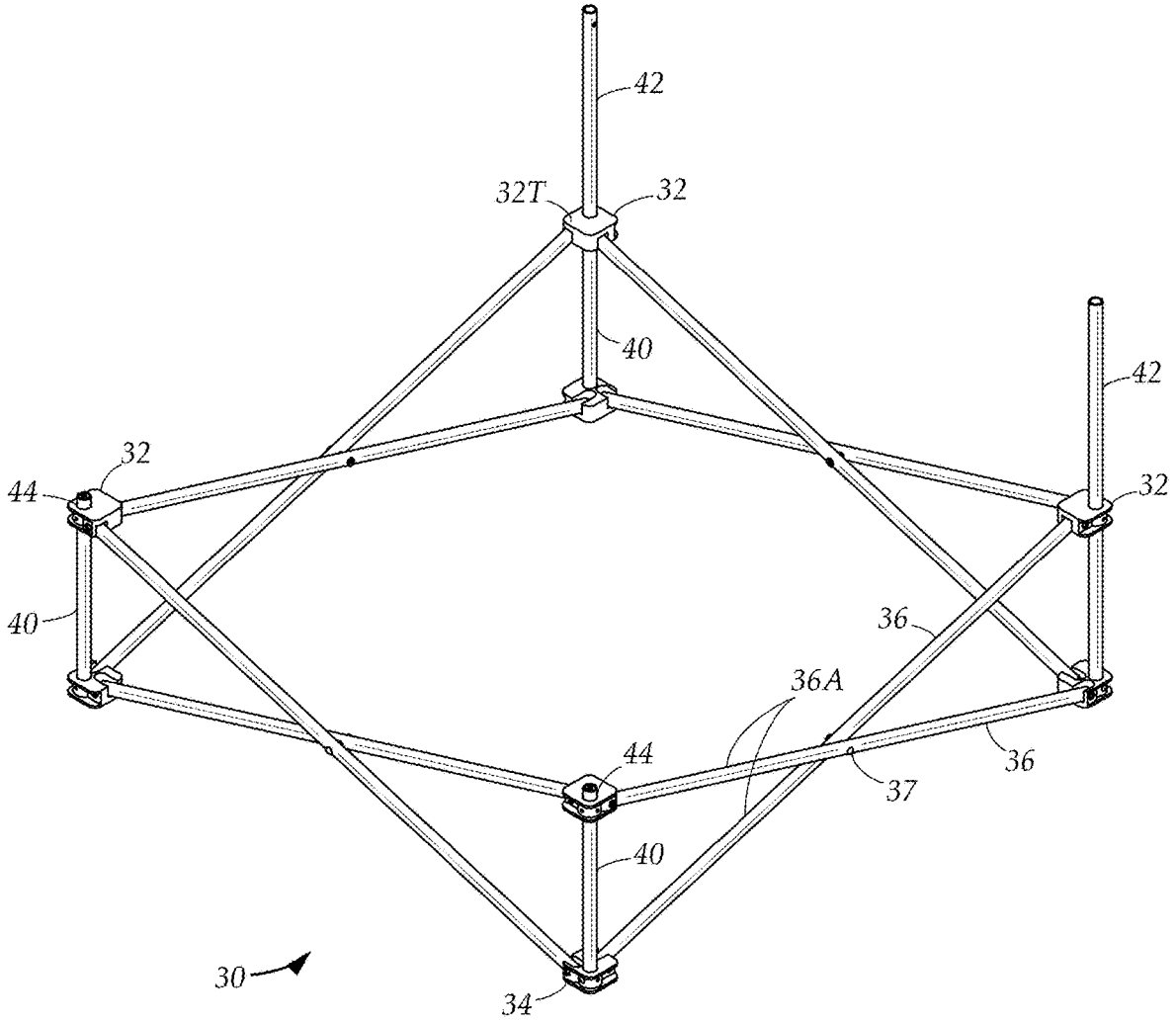
FIG. 3 is a diagrammatic perspective view, illustrating the primary frame fully unfolded, with the vertical masts thereof extending through the upper attachment connectors.

FIG. 3 illustrates the primary frame 30 fully unfolded, in a fully deployed position, wherein the vertical masts 40 extend through the upper attachment connectors 32. In the example illustrated, two of the vertical masts have extended uprights 42 which extend well above the top surface 32T of their associated upper attachment connectors 32, while the other two of the vertical masts 40 each have a short protrusion 44 which extend only a short distance above the top surface 32T of their associated upper attachment connectors 32. The horizontal supports 36 are each pivotally connected to one of the upper attachment connectors 32 and one of the lower attachment connectors 34, and can pivot approximately ninety degrees with respect to said connectors 34, from a near parallel position with respect to the said connector (when fully deployed as in FIG. 3) to a near perpendicular position with respect to said connector (when fully folded as in FIG. 1). Note that the pivot point 37 and the geometry of connection with the other horizontal support 36 in the pair, however will prevent the supports 36 from reaching that near parallel position, and in practice the range of motion of each support 36 between fully folded and fully deployed is more like seventy to eighty degrees.

Figure 3A:
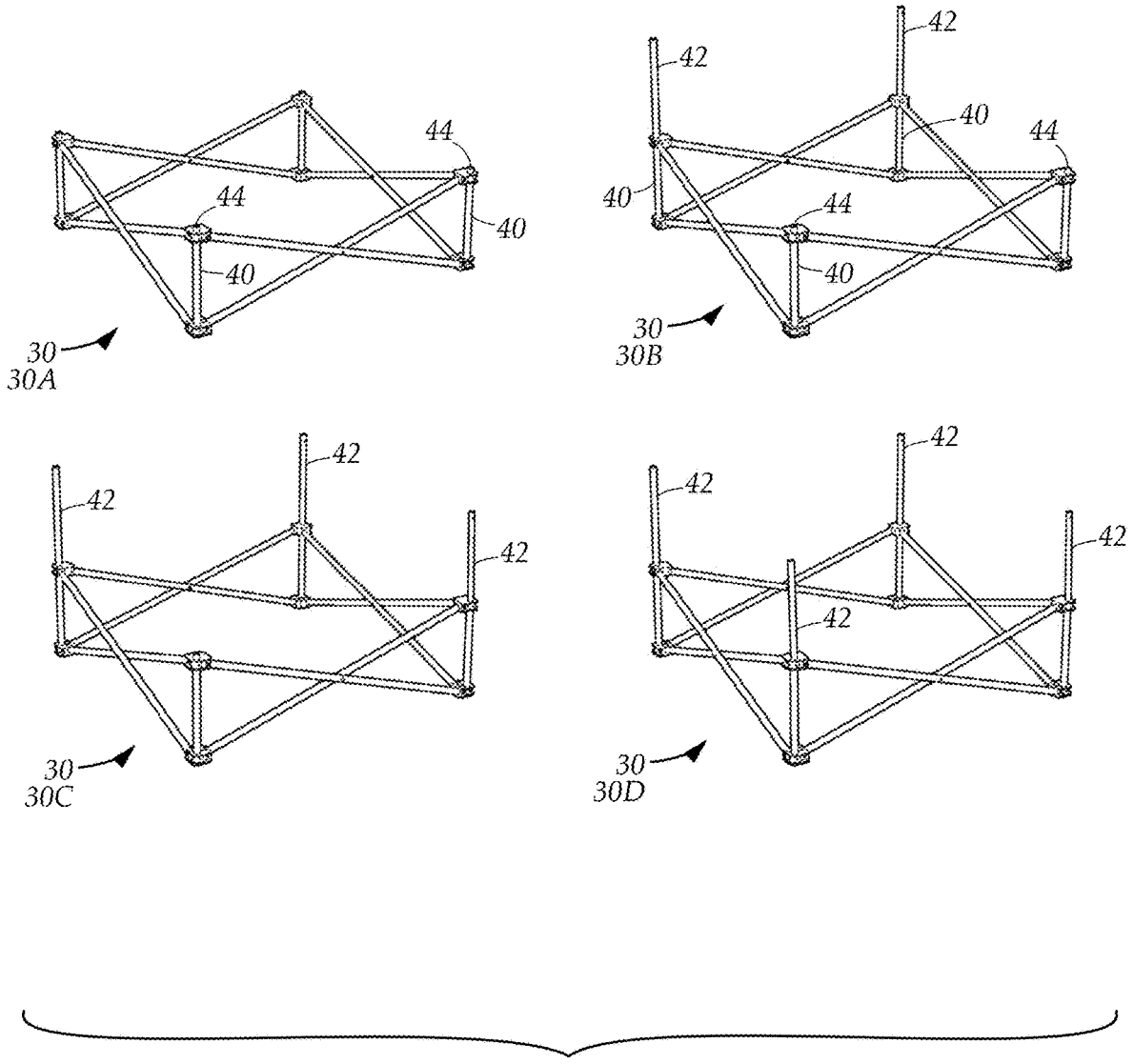
FIG. 3A is a diagrammatic perspective view, showing alternative versions of the primary frame, having two, three, or four extended uprights, for armless, corner, or armchair configurations, and also a version having no extended uprights, for an ottoman configuration.
Figure 3B:
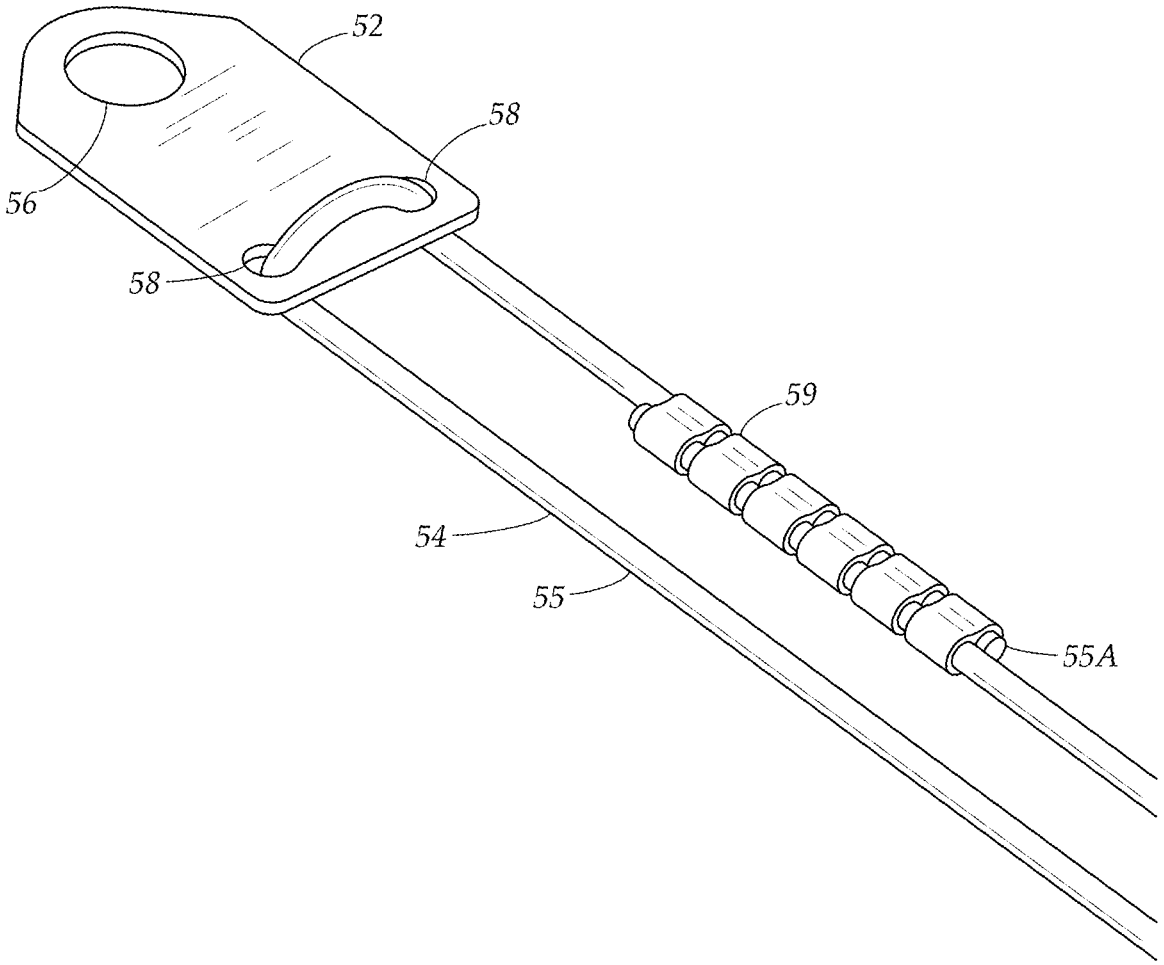
FIG. 3B is a diagrammatic perspective view, showing a portion of a deck support assembly.
Figure 3C:
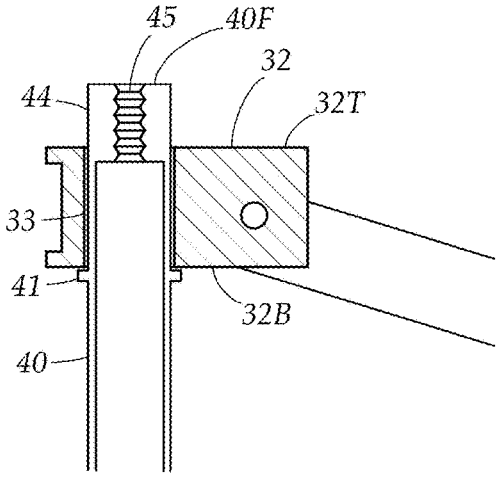
FIG. 3C is a side elevational view with parts broken away, showing one of the vertical masts having a short protrusion, extending through one of the upper attachment connectors.
Figure 3D:
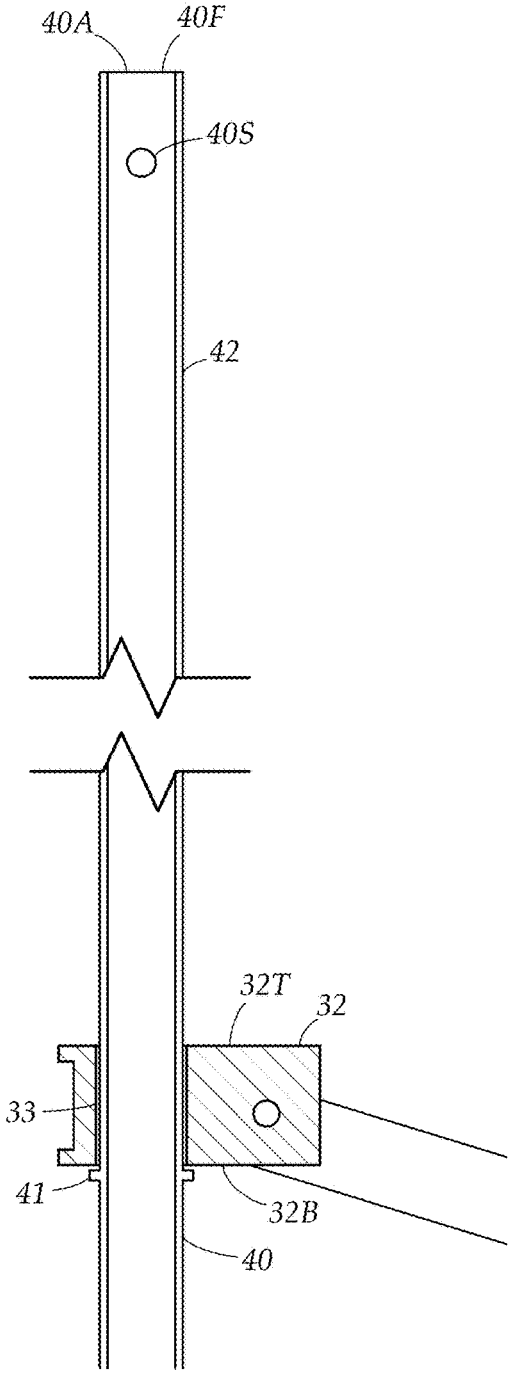
FIG. 3D is a side elevational view with parts broken away, showing one of the vertical masts having an extended upright, extending through one of the upper attachment connectors.

Referring to FIG. 3C and FIG. 3D, the upper attachment connectors 32 have a vertical bore 33 extending fully from the bottom surface 32B to the top surface 32T. When unfolding the frame 30 (as shown in FIG. 2 and FIG. 3), each vertical mast 40 is extended into the vertical bore 33 of its associated attachment connector 32 from the bottom surface 32B thereof. The vertical mast 40 continues upwardly through the vertical bore 33 until the flange 41 meets the bottom surface 32B of said attachment connector. FIG. 3C shows the vertical mast 40 with the short protrusion 44. Note that the short protrusion 44 has an internally threaded opening 45 extending downwardly from the free end 40F. FIG. 3D shows the vertical mast 40 with the extended upright 42, extending a significant distance above the connector 32. Note that the vertical mast 40 is tubular, and has a top opening 40A at the free end 40F for accepting another tubular item, and a side opening 40S near the free end 40F.

FIG. 3A illustrates different configurations of the primary frame 30. Illustrated are an ottoman configuration 30A, an armless configuration 30B, a corner configuration 30C, and an armchair configuration 30D. In the ottoman configuration 30A, all vertical masts 40 have a short protrusion 44. In the armless configuration 30B, two of the vertical masts 40 have extended uprights 42, and the other two short protrusions 44. In the corner configuration 30C, three of the vertical masts 40 have extended uprights 42. In the armchair configuration 30D, four of the vertical masts 40 have extended uprights 42.

Figure 4:
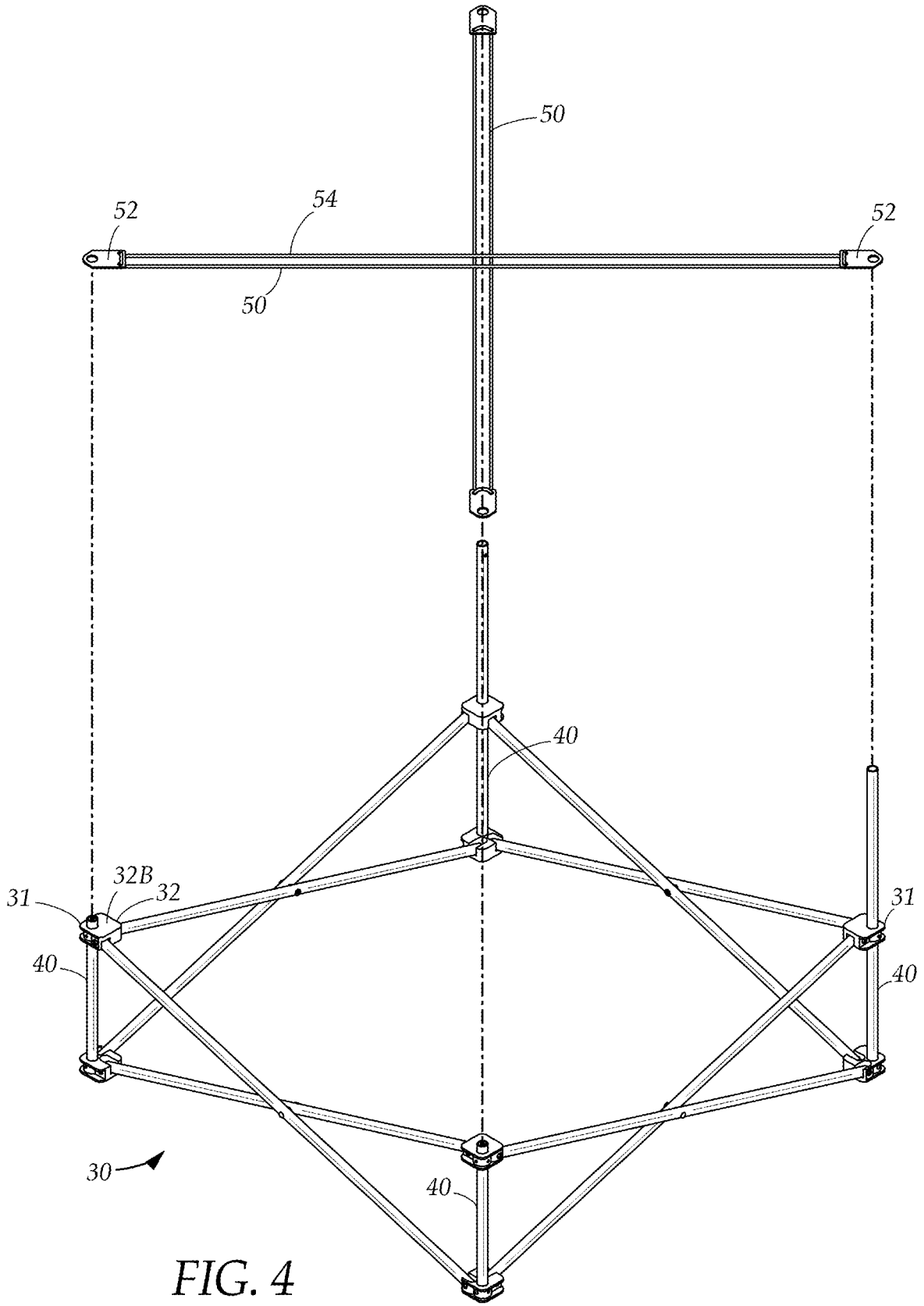
FIG. 4 is a diagrammatic perspective view, illustrating the deck support assemblies being installed to span diagonally between the upper attachment connectors.

Referring to FIG. 4, a pair of deck supports 50 are extended diagonally across the frame 30, from corner to opposite corner 31 where they are set to attach onto the vertical masts 40 at the attachment connectors 32, by extending downwardly thereupon until they reach the top surface 32B of the upper attachment connectors 32. Each deck support 50 has a pair of deck support plates 52, and a cable loop 54 extending between the deck support plates. Referring to FIC 3B, each deck support plate 52 has a mounting opening 56, and a pair of cable openings 58. The cable loop 54 includes a cable 55 that has two ends 55A that extend through both of the cable openings 58, to the other deck support plate 52, and back. The ends 55A of the cable 55 are secured together by a coupler 59 to create the closed, cable loop 54. The coupler 59 employed may be of the type that permits tension adjustment, such as a turnbuckle, or may be a fixed coupler that crimps onto the ends 55A of the cable 55 as shown.

Figure 5:
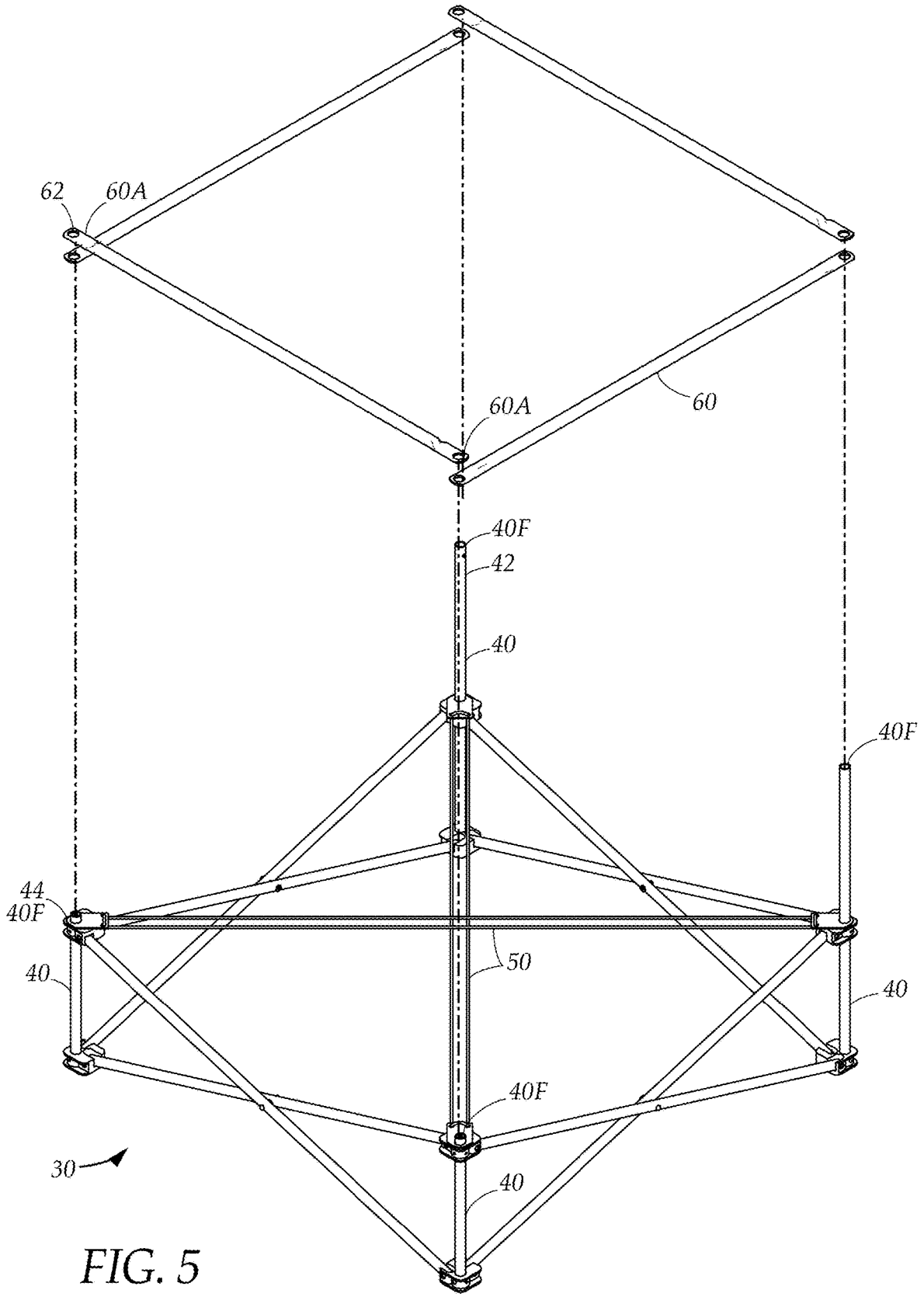
FIG. 5 is a diagrammatic perspective view, illustrating brace bars extending between the upper attachment connectors on an upper perimeter of the primary frame.

Referring now to FIG. 5, the deck supports 50 are installed, each spanning diagonally across the frame 30. The deck supports 50 have been extended downwardly over the free end 40F of diagonally opposite vertical masts 40. Four brace bars 60 are also shown positioned over their eventual installation positions where they will span between adjacent vertical masts 40. Each brace bar 60 is a generally flat but somewhat rounded metal bar, having flattened end plates 60A with a mounting hole 62 that is sized to allow the short protrusion 44 or extended upright 42 of the vertical masts 40 to extend therethrough. As will be seen hereinafter, generally two of the brace bars 60 are individually installed directly on the vertical masts 40 as seen in FIG. 6, and two of the brace bars are installed indirectly with the deck pad 70, as will be described hereinbelow in the discussion of FIG. 7A, FIG. 7B, and FIG. 8.

Figure 6:
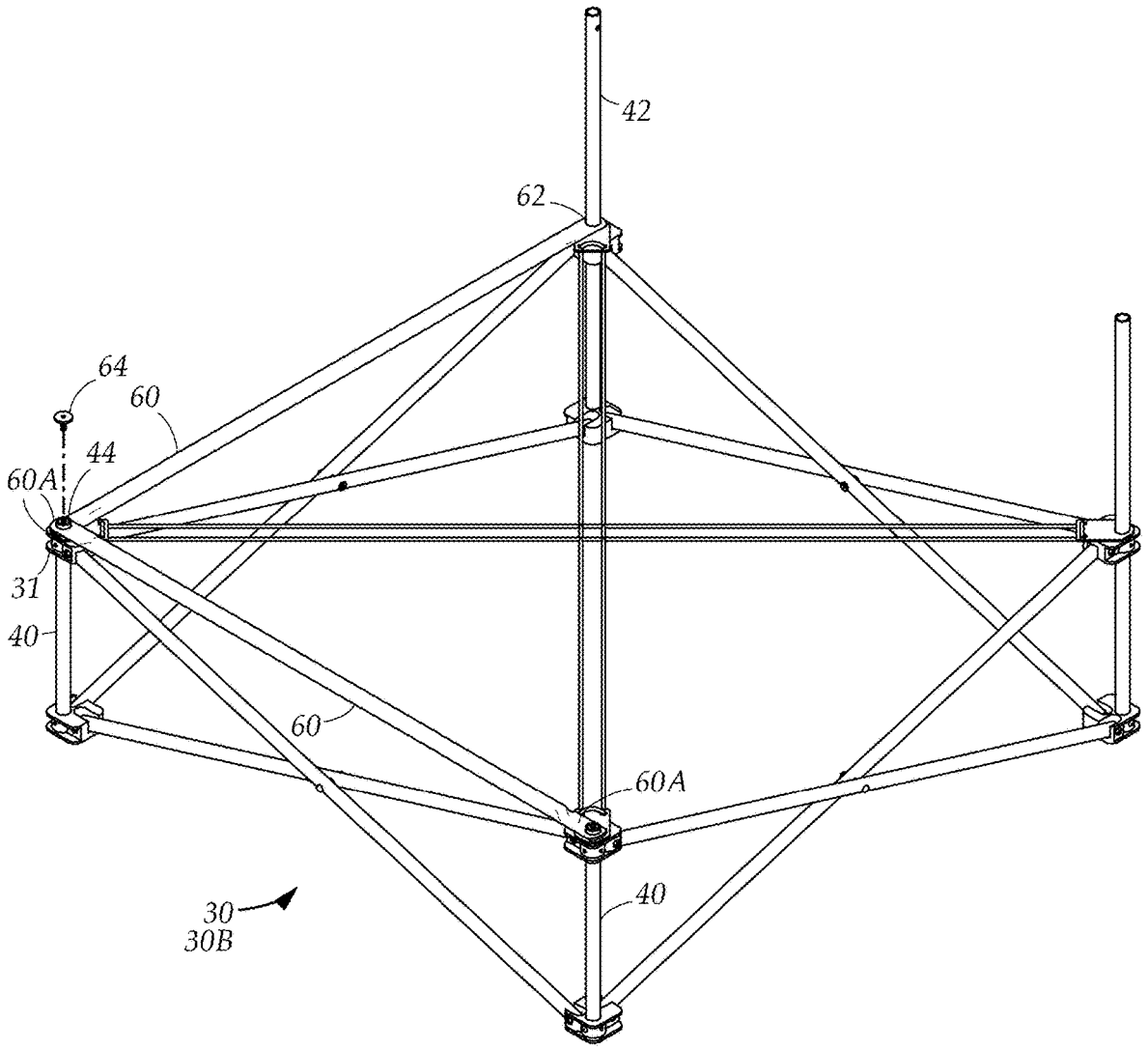
FIG. 6 is a diagrammatic perspective view, illustrating two brace bars extending between adjacent upper attachment connectors, and a top screws about to be threaded into one the vertical masts to secure the brace bars and deck support assemblies in place.
Figure 7:
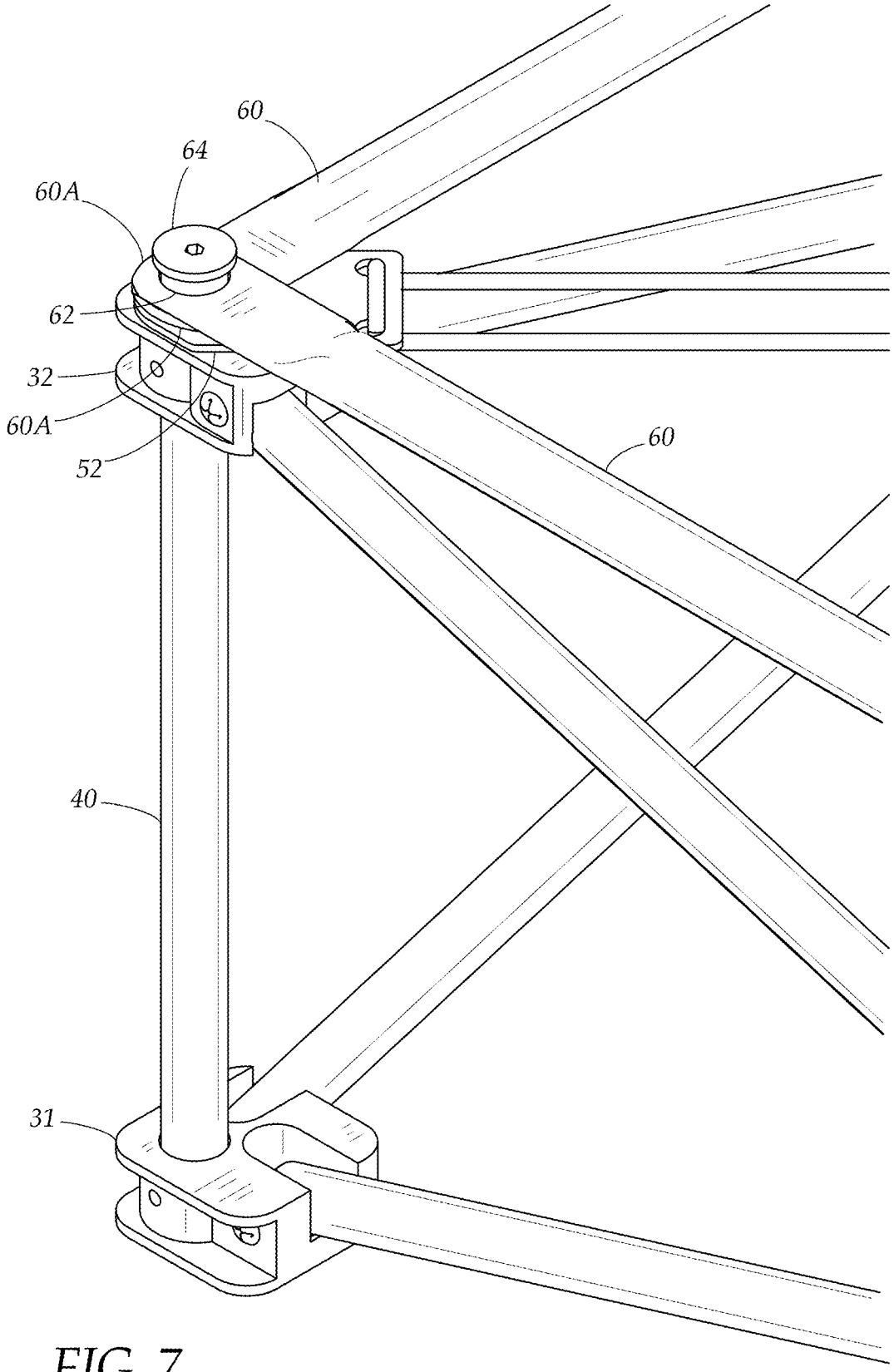
FIG. 7 is an enlarged diagrammatic perspective view, detailing the vertical mast extending between upper and lower attachment connectors, and the securing of the brace bars and deck support assembly using the top screw.

Accordingly, referring to FIG. 6, two of the brace bars 60 have been installed onto the frame 30, both bars 60 extending between vertical masts 40 at adjacent corners of the frame 30, with the flattened end plates 60A of the two brace bars 60 overlapping at one of the corners 31 of the frame 30. The vertical masts 40 extending through the mounting holes 62. Note that for this armless configuration 30B of the frame 30, one of the bars 60 extends on one side over one of the extended uprights 42 and on another end over one of the short protrusions 44. As seen in FIG. 7, a top screw 64 is extended through the mounting holes 62 in the overlapping flattened end plates 60A of both bars 60 and into the threaded opening, to secure both bars 60, the attachment connector 32, and the deck support plate 52 to the vertical mast 40 at that corner 31.

Figure 7A:
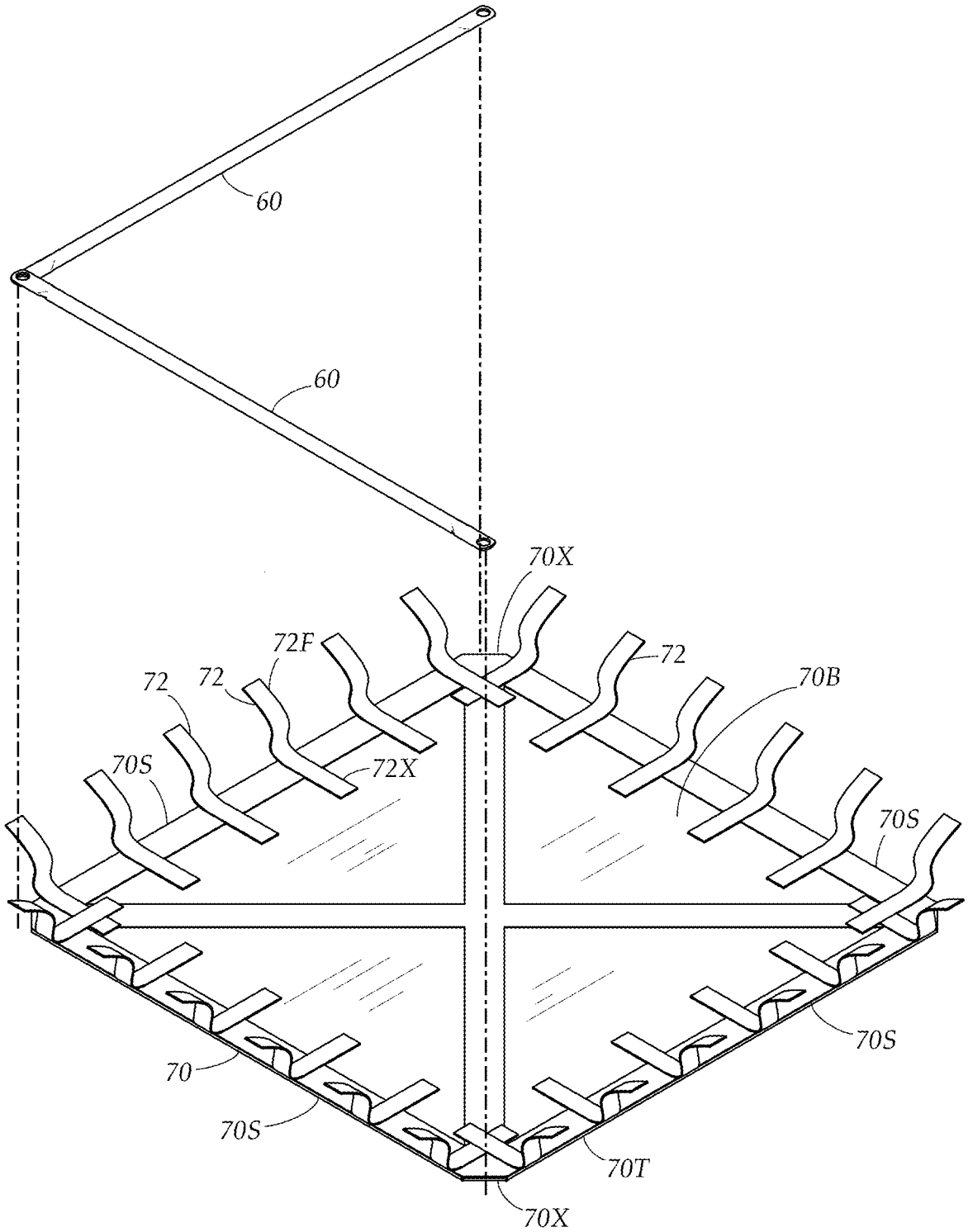
FIG. 7A is a diagrammatic perspective view, showing a deck pad in an inverted position, and illustrating two of the brace bars, about to be installed along the edges thereof.
Figure 7B:
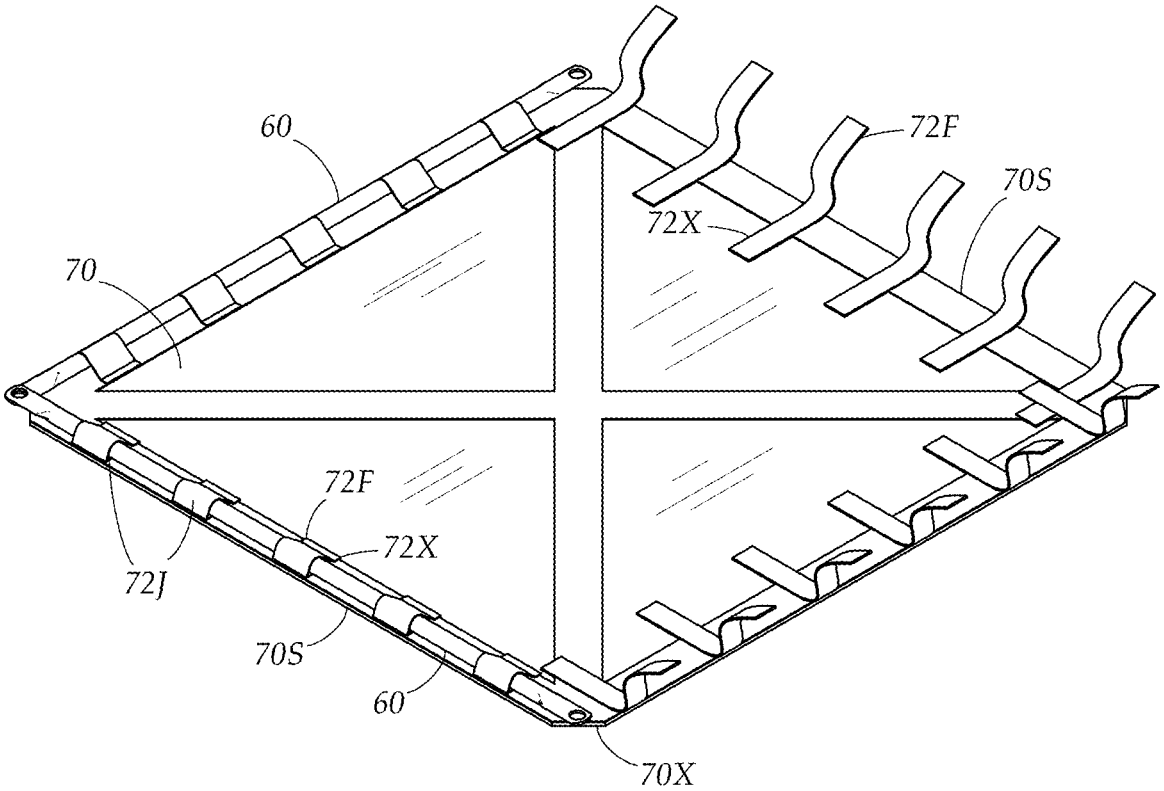
FIG. 7B is a diagrammatic perspective view, illustrating two brace bars secured in place against the bottom of the deck pad with securing straps, along two adjacent edges of the deck pad.

FIG. 7A shows the deck pad 70 in an inverted position. The deck pad 70 has four corners 70X which are truncated or notched, a bottom 70B surface, a top surface 70T, and four side edges 70S. The deck pad 70 may be constructed of a heavy duty, extremely strong and durable fabric. The deck pad 70 has a plurality of fastening straps 72 attached to the bottom 70B. Each of the fastening straps 72 has a fixed part 72X and a free part 72F. The fastening straps 72 have mateable fastener material, such as hook and loop closures, that allow the free part 72F to secure to the fixed part 72X when pressed thereagainst. Each of the fastening straps extends transverse to one of the side edges 70S such that a fixed part 72X of said fastening strap 72 is secured to the bottom 70B of the deck pad 70 inwardly of and near said side edge 70S and, in some embodiments, the free part 72F extends outwardly beyond said side edge 70S. A plurality of the fastening straps 72 extend transversely along each of the side edges 70S. As shown in FIG. 7A, two of the brace bars 60 are preferably secured to the deck pad 70 prior to its installation onto the frame 30. In particular, in their ultimate position, each of the brace bars 60 extends under the deck pad 70, near each of the side edge edges 70S. This may be accomplished in two steps, however, as illustrated in FIG. 7B, two of the brace bars 60 are attached to the deck pad 70 using the fastening straps 72 prior to installation to the frame. Such attachment may take place in accordance with the embodiment of FIG. 7A, by pulling the free parts 72F of each fastening strap 72 over the brace bar 60 and then securing the free part 72F to the fixed part 72X. In accordance with the embodiment of FIG. 7B, however, the free part 72F of all of the straps 70 along two side edges 70S of the deck pad 70 may already be secured to the fixed part 72X into fixed loops 72J, creating a channel transverse to all of the straps on said side edge 70S. Accordingly, the bar 60 is slid into place from one of the corners 70X of the deck pad 70, through all of the fixed loops 72J along said side edge 70S.

Figure 8:
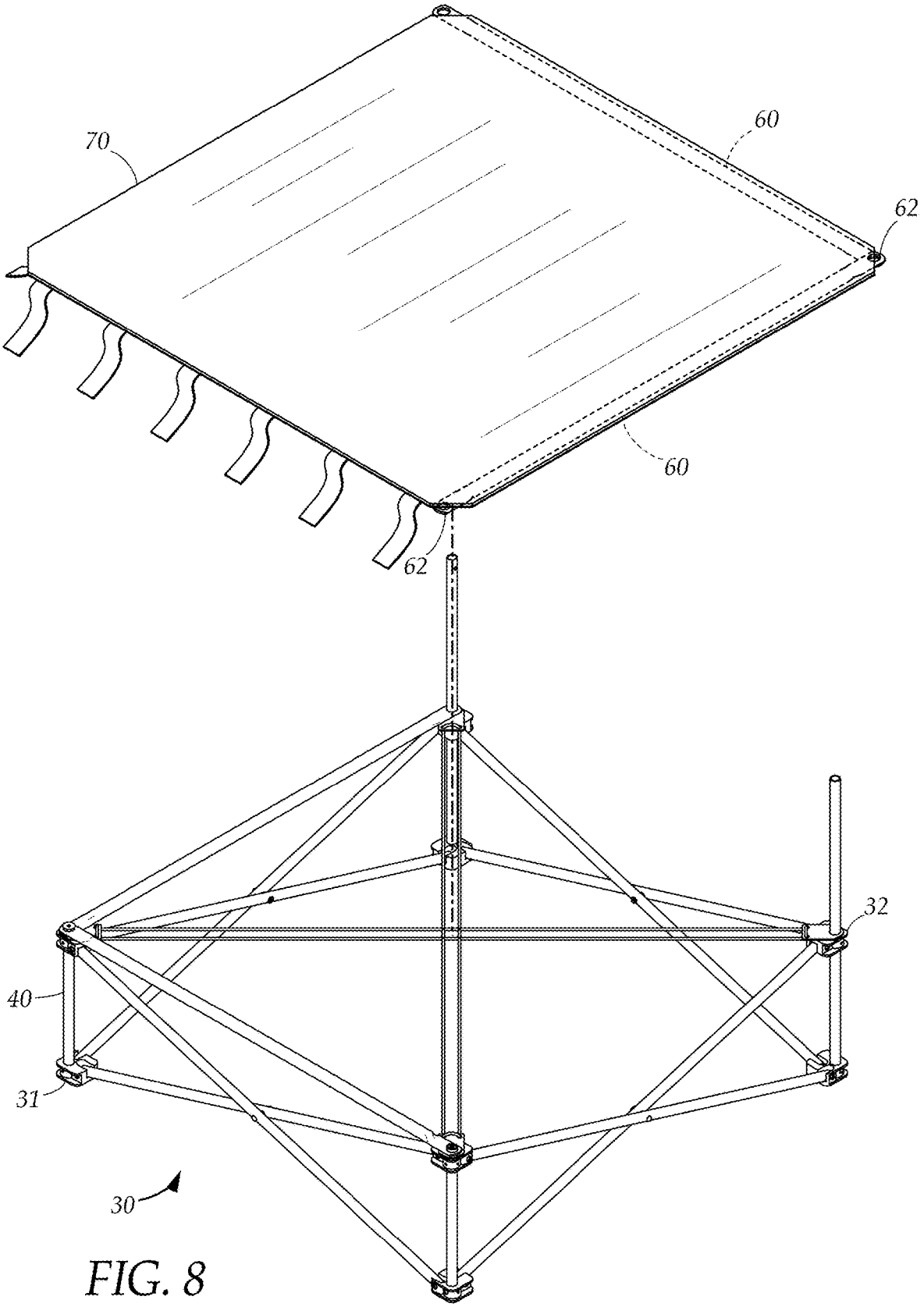
FIG. 8 is a diagrammatic perspective view, illustrating the deck pad righted and about to be attached to the primary frame.
Figure 8A:
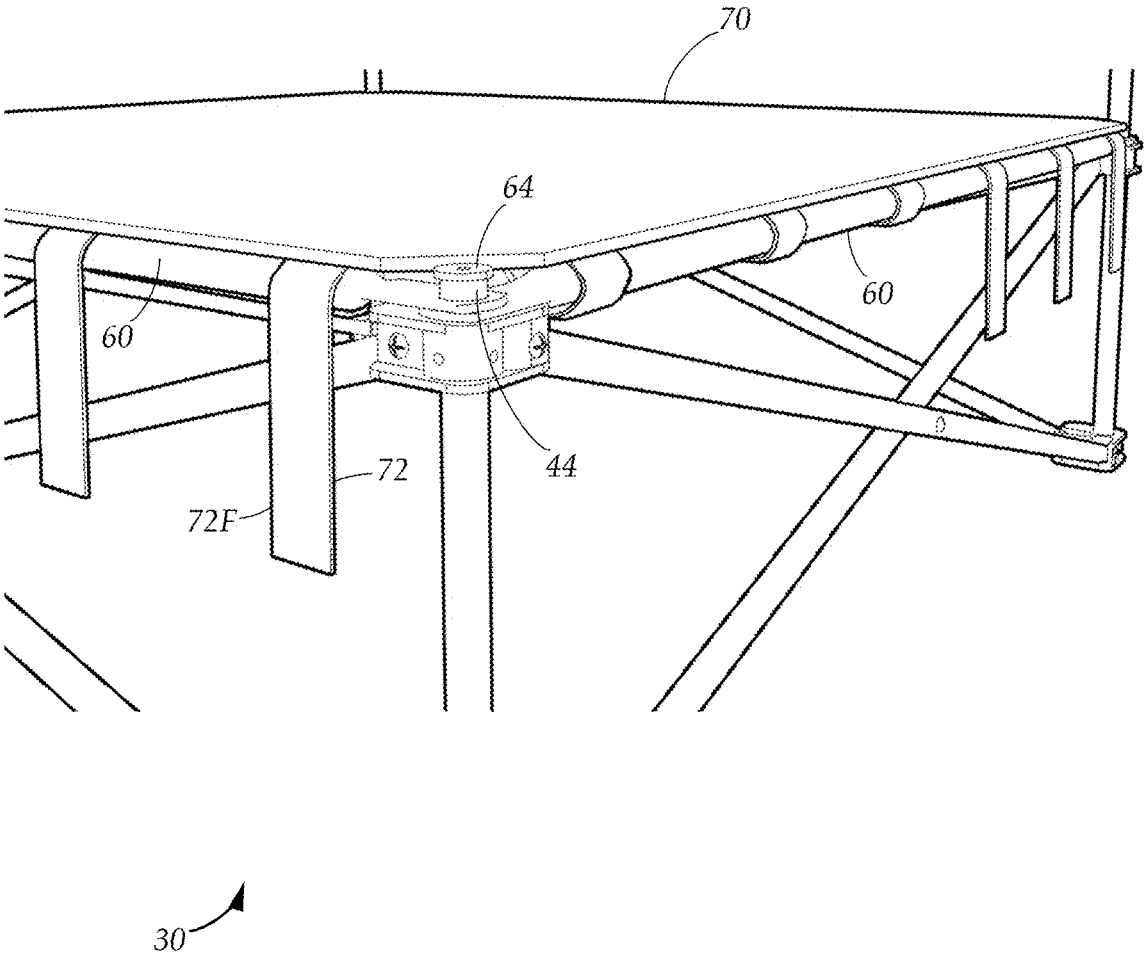
FIG. 8A is a diagrammatic perspective view, illustrating the deck pad being secured to the braces using securing straps.

With two bars in place 60 beneath the deck pad 70, the deck pad 70 is then inverted and positioned directly over the frame 30, such that the corners of the deck pad 70X are aligned with the corners 31 of the frame 30, as seen in FIG. 8. The mounting holes of the brace bars 60 in the deck pad 70 are aligned with the vertical masts 40 as the deck pad is lowered onto the frame, such that the vertical masts 40 then extend through the mounting holes 62, and then deck pad 70 is fully lowered onto the frame 30. Referring to FIG. 8A, as the deck pad 70 is positioned on top of the frame 30, the free ends 72F of all open fastening straps 72 are draped over the brace bars 60, outwardly of the frame 30 as shown. Then the free ends 72F are pulled taught under the bars 60 and are fastened to the fixed ends 72X (see FIG. 7A) to secure the deck pad 70 in place. In addition, at any corner with a short protrusion 44, one of the top screws 64 is fastened thereto to secure the bars 60 to the upper attachment connectors 32.

Figure 9:
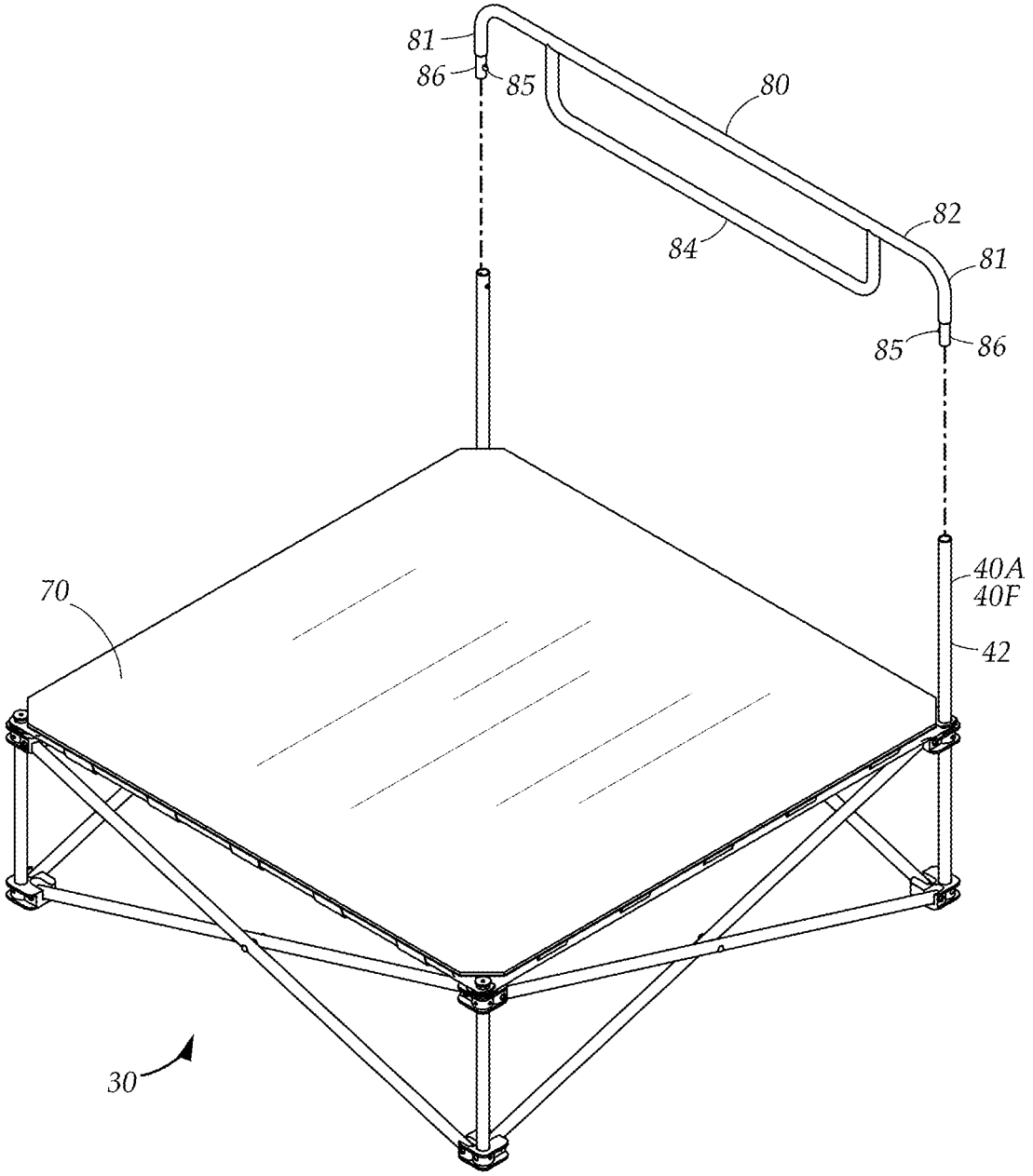
FIG. 9 is a diagrammatic perspective view, illustrating a cross bar being attached to extended uprights of the vertical masts.
Figure 10:
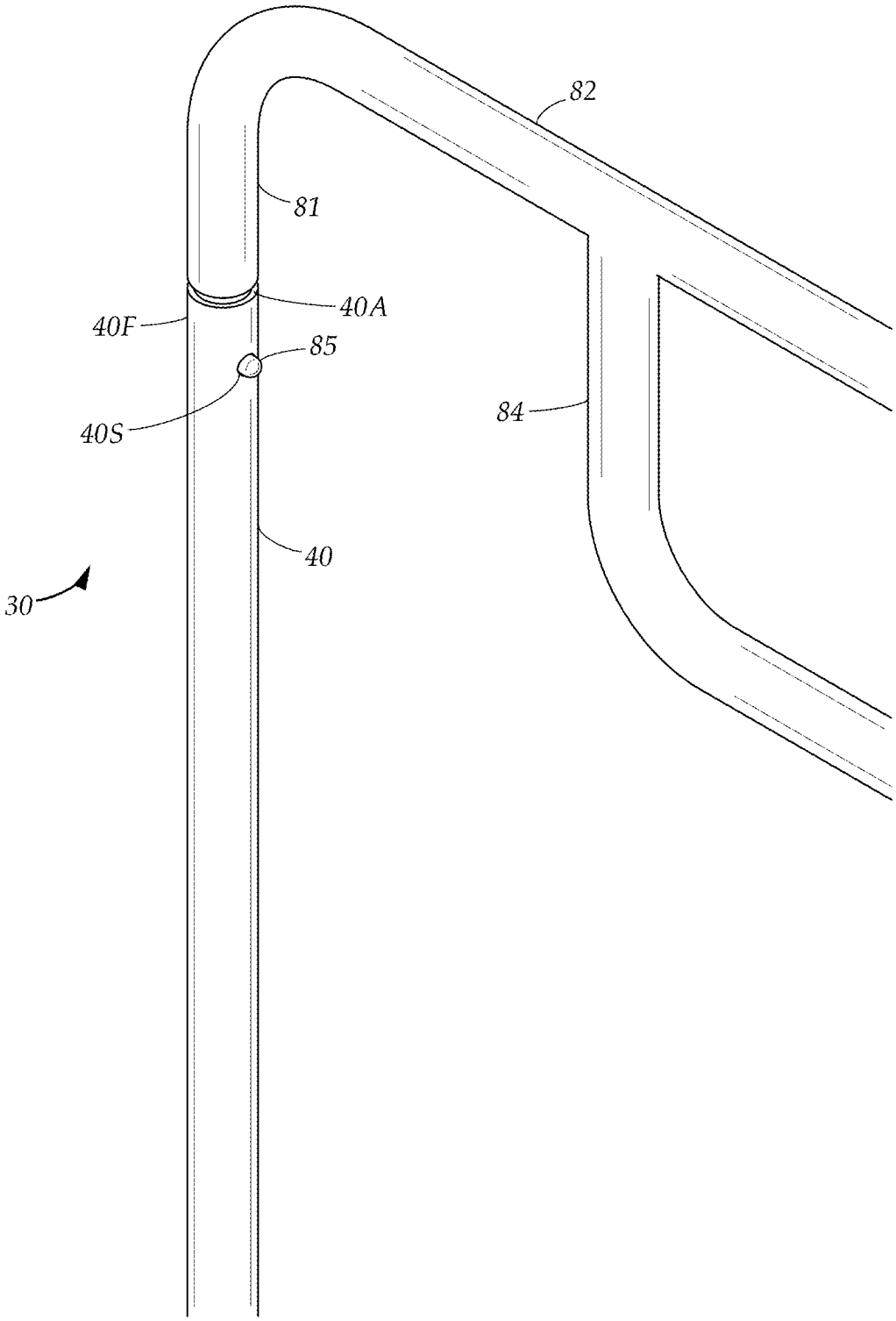
FIG. 10 is an enlarged diagrammatic perspective view, detailing connection of the cross bar to one of the extended uprights.

Referring to FIG. 9, with the deck pad 70 secured in place, assembly of the frame 30 may require adding one or more cross bars 80. The cross bar 80 is generally U-shaped, including two vertical legs 81, a horizontal leg 82 extending perpendicular and between the two vertical legs 81, and a mid-support 84. The mid support 84 is an upward-U shaped element that attaches to the horizontal leg 82 and is inset within the vertical legs 81 and horizontal leg 82 and coplanar therewith to provide a second point of support for pillows and the like. The two vertical legs each have a detent pin 85, for mating with the free end of the extended uprights 42. Referring to FIG. 9 and FIG. 10, each of the vertical legs 81 has a plug 86, having a diameter that is smaller than the vertical leg 81 and thereby configured to fit within the top opening 40A at the free end 40F of the extended upright 42. In particular, the cross bar 80 is mated with the frame 30 by extending the plugs 86 of the cross bar 80 into the top opening 40A until the detent pin 85 pops into the side opening 40S of the extended upright 42.

Figure 11:
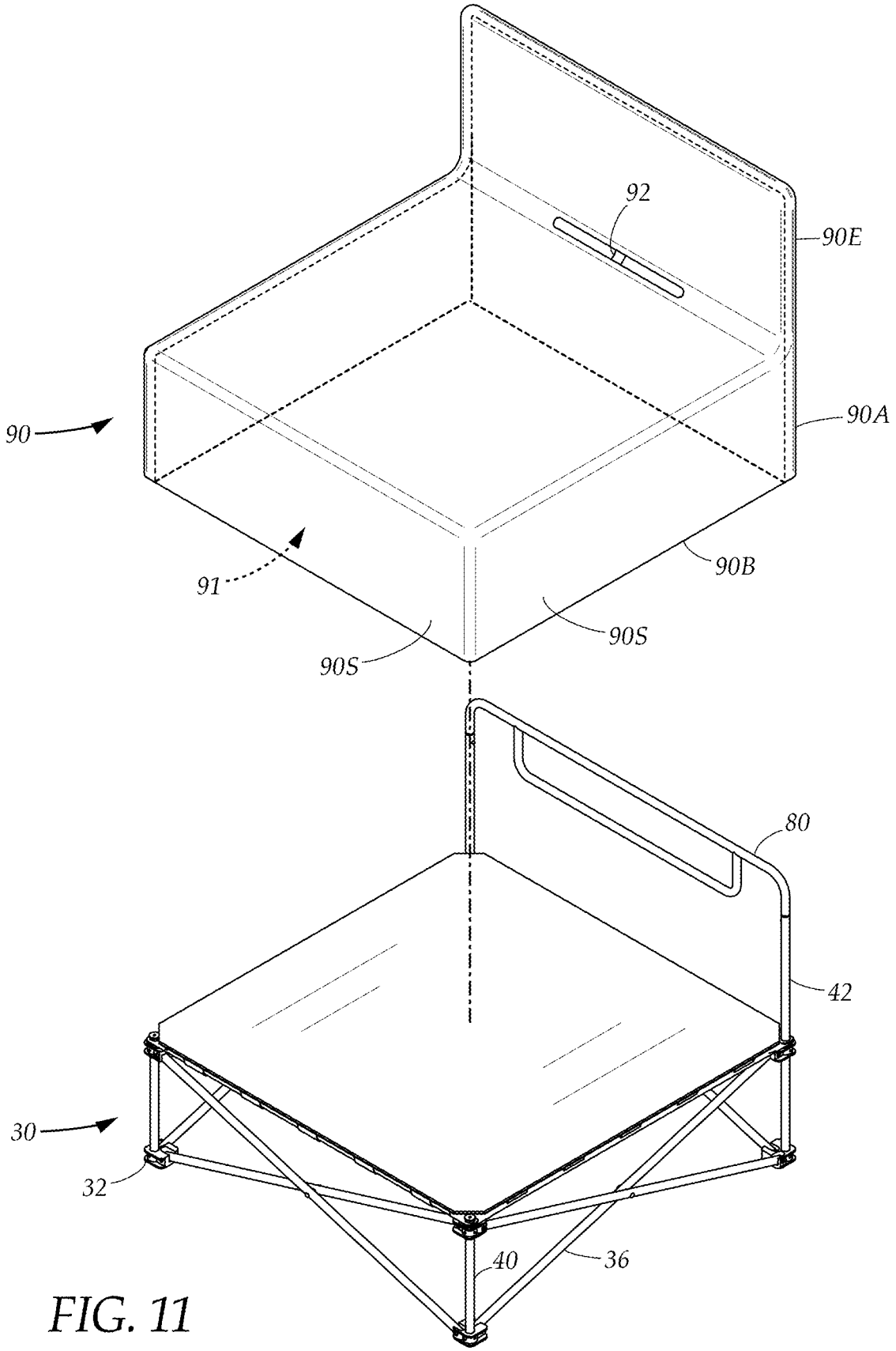
FIG. 11 is a diagrammatic perspective view, illustrating the duvet cover being installed onto the frame assembly.

Referring to FIG. 11, a duvet cover 90 is extended over the fully assembled frame 30. The duvet cover 90 is made of a durable and machine washable fabric, and has a bottom edge 90B, and an internal cavity 91. The bottom edge 90B is open to the internal cavity 91. The duvet cover is sized and shaped to fully cover the frame 30. Accordingly, the duvet cover has a generally rectangular base 90A that has lower sides 90S that are configured to cover the frame 30 to the level of the lower attachment connectors 34. The duvet cover 90 may have one or more upper extensions 90E where the internal cavity is continuous with the base 90A, to cover the extended uprights 42 and cross bars 80 in appropriate versions of the frame 30. Note that the duvet cover may include an elastic portion 92 between the upper extension 90E and base 90A to ensure a better fit upon the frame 30 and to prevent fabric from bunching where the upper extension 90E and base 90A meet. The duvet cover 90 may be fitted with internal straps (not shown), near the bottom edge 90B that may be tied around the vertical masts 40 or horizontal members 36 to secure the duvet cover 90 in place and prevent it from shifting during use.

Figure 12:
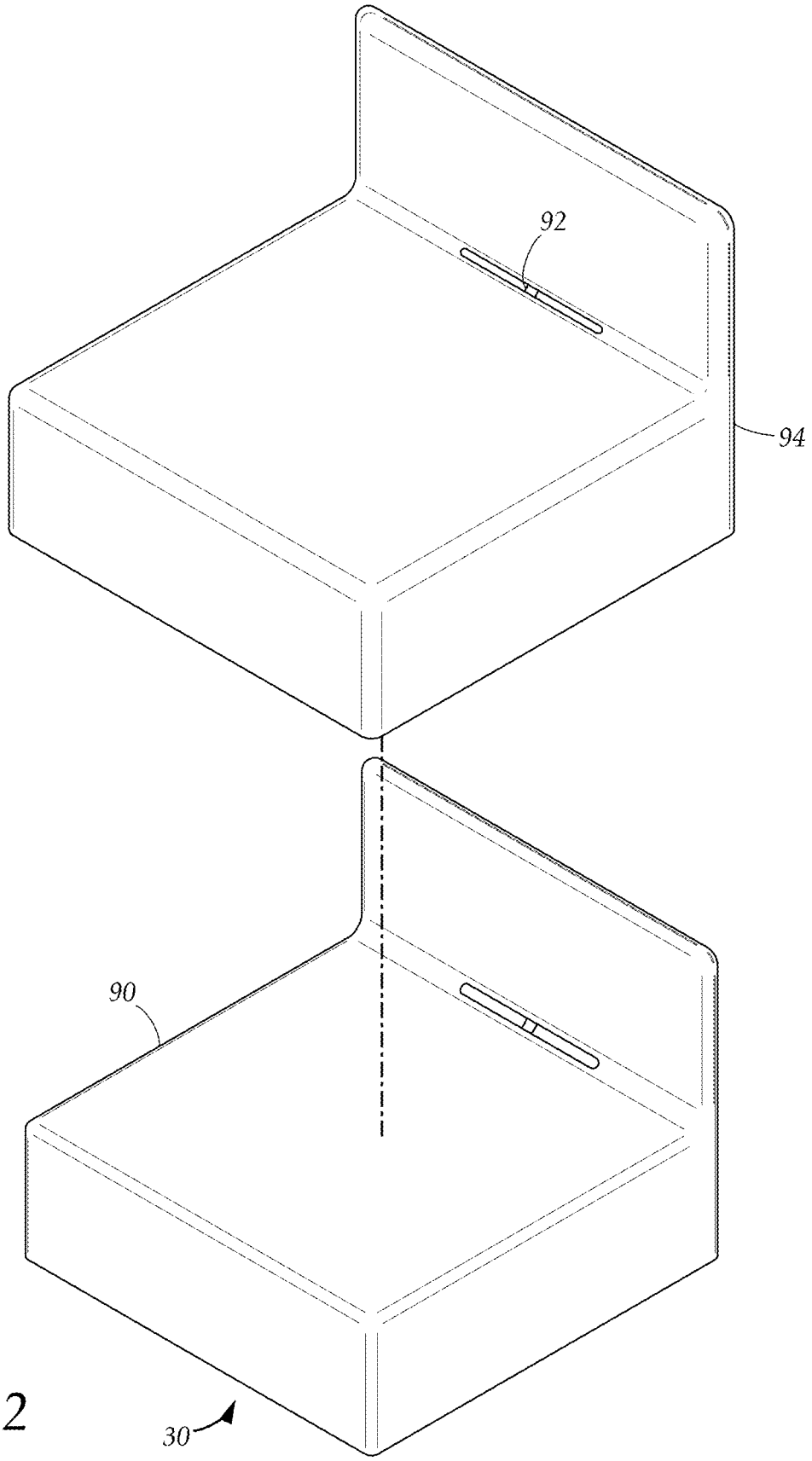
FIG. 12 is a diagrammatic perspective view, illustrating a decorative cover being installed over the duvet cover.

Referring to FIG. 12, once the duvet cover is installed 90, fully concealing the frame 30 therewithin, the duvet cover may itself be covered with a decorative cover 94. The decorative cover 94 may be made of a variety of durable, attractive, and machine washable fabrics. The decorative cover 94 is substantially sized, shaped, and configured like the duvet cover 90. As indicated, the decorative cover 94 is installed downwardly onto the duvet cover 90, just as the duvet cover 90 was previously installed.

Figure 13:
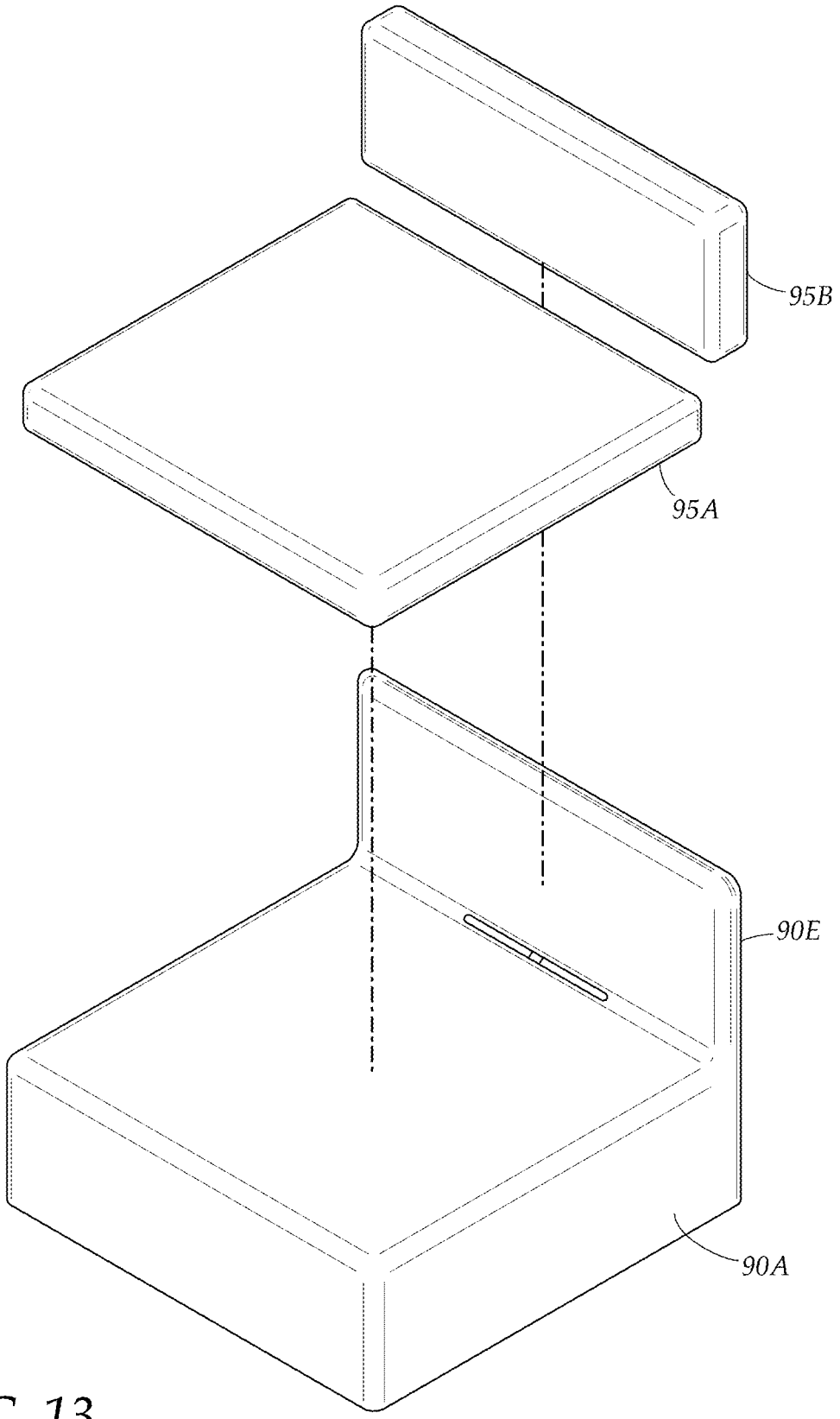
FIG. 13 is a diagrammatic perspective view, illustrating horizontal and vertical cushions being installed onto the decorative cover to provide a completed armless seating module.
Figure 14:
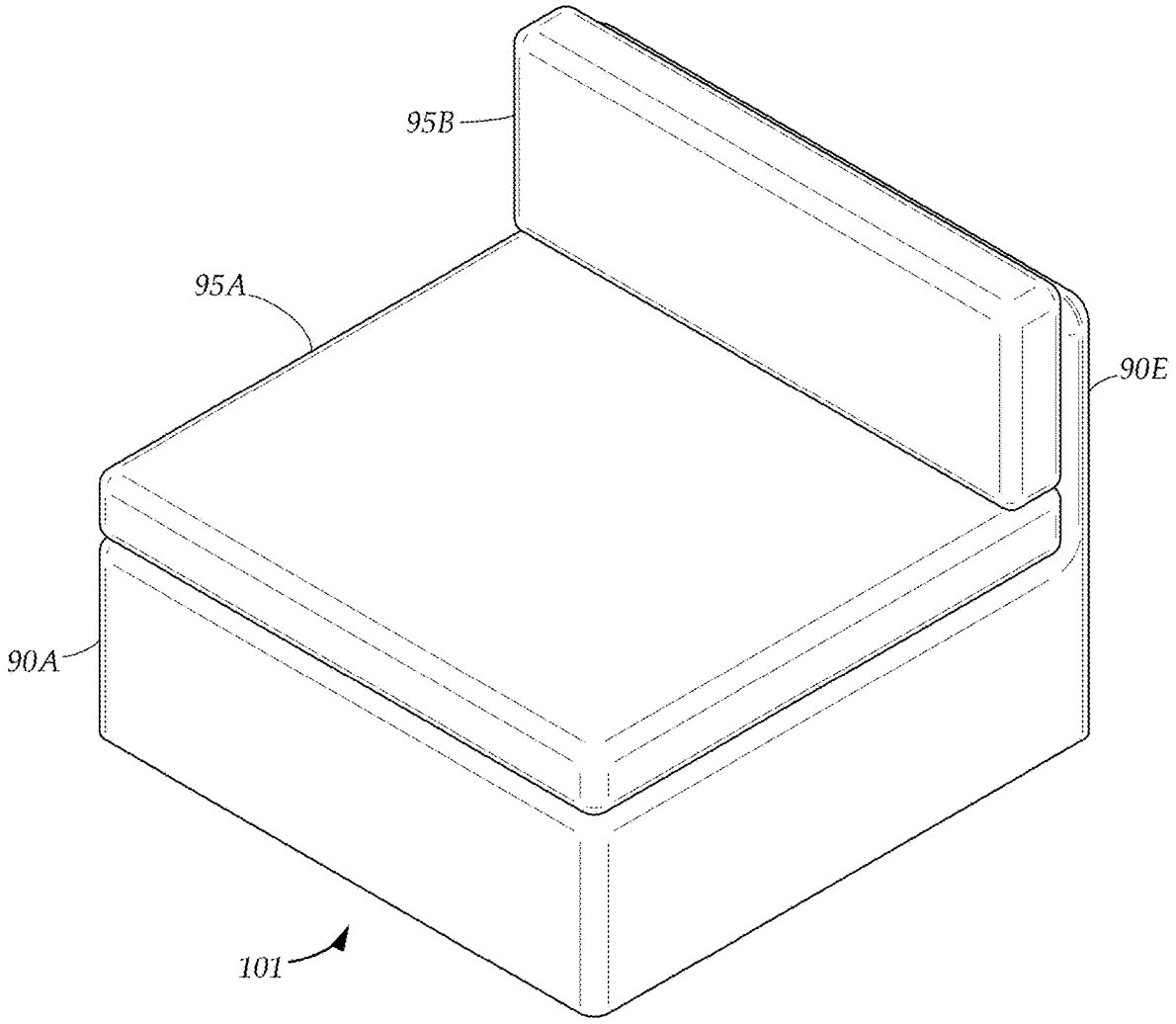
FIG. 14 is a diagrammatic perspective view, illustrating the completed armless seating module.

Referring to FIG. 13 and FIG. 14, seat cushions 95A and a back cushion 95B may be installed onto the base 90A and against the upper extension 90E to provide a complete armless seating module 101.

Figure 19:
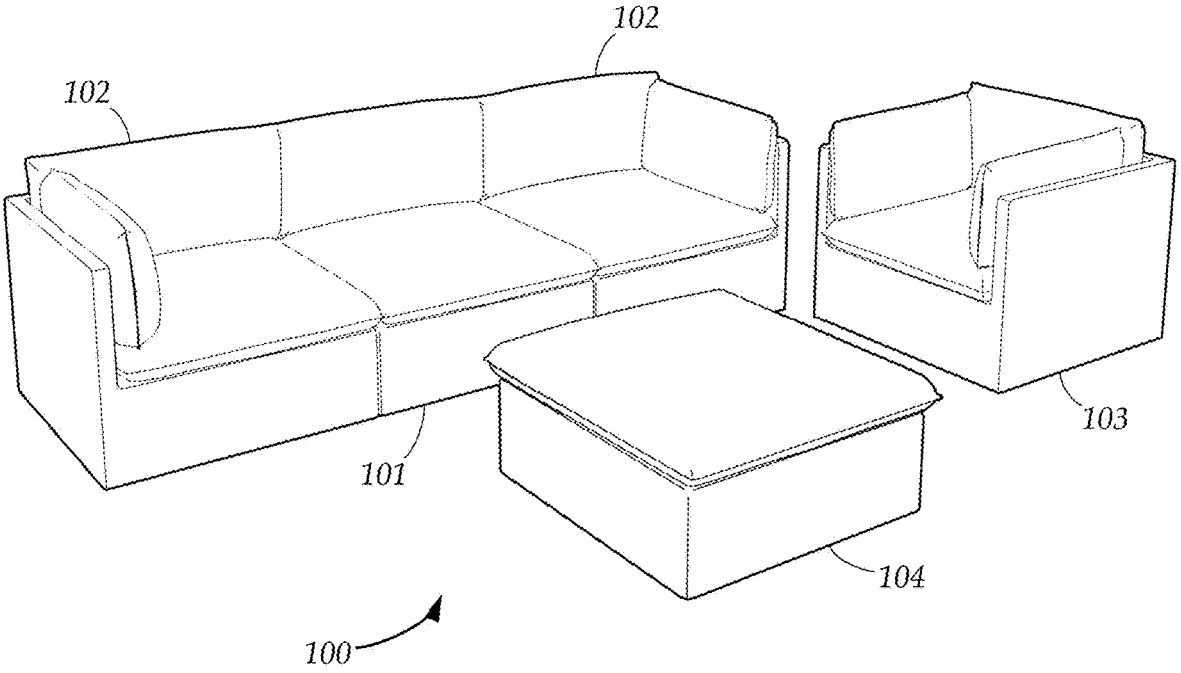
FIG. 19 is a diagrammatic perspective view, showing a combination of seating modules, that includes ottoman, armless, corner, and armchair configurations.
Figure 20A:
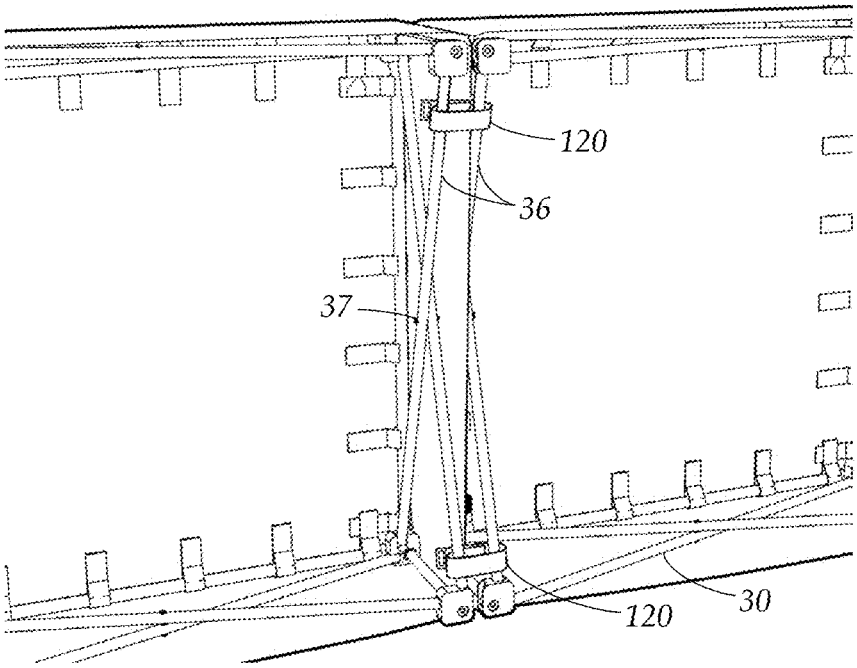
FIG. 20A is a diagrammatic perspective view, showing two modules that are inverted, and are being strapped together in a side-by-side configuration.
Figure 20B:
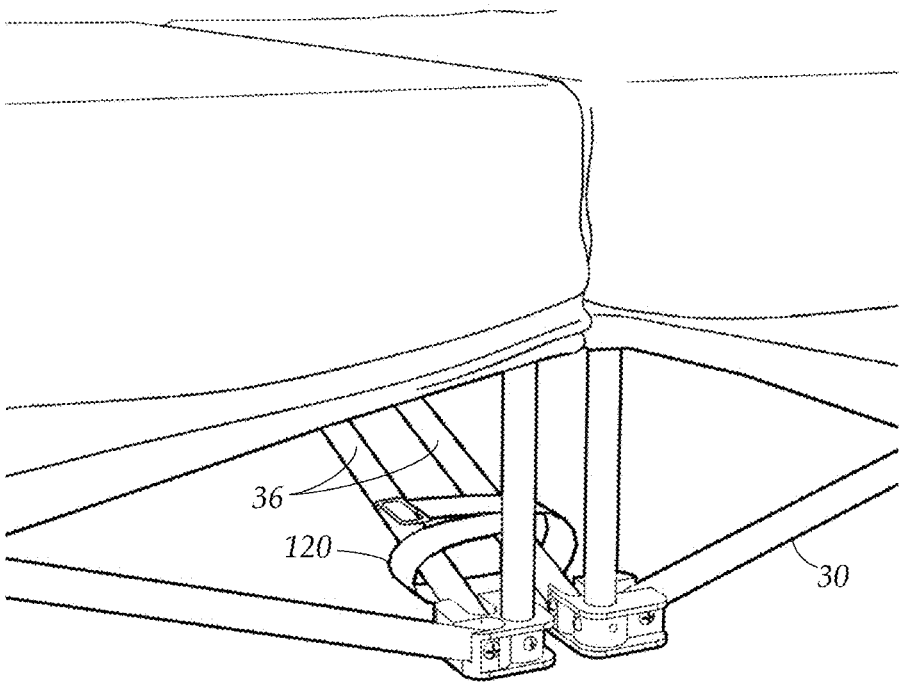
FIG. 20B is a diagrammatic perspective view, wherein the duvet cover and decorative cover has been lifted at the front to secure two modules together.

Referring to FIG. 19, a seating module system 100 is illustrated, including the armless seating module 101, a pair of corner seating modules 102, an armchair seating module 103, and an ottoman seating module 104. Such modules can be configured in numerous arrangements. Note, in this arrangement, the corner seating modules 102 are used as end units, which simply requires a slightly different cushion/pillow arrangement. Referring to FIG. 20A and FIG. 20B, when seating modules are placed side by side, they may be joined by connecting straps 120, to help stabilized them and prevent them from sliding apart. Accordingly, a preferred manner of joining the seating modules is to secure the connecting straps 120 around the horizontal members 36 of the frame 30 of the adjacent modules, with one strap on each side of the pivot point 37.

Figure 15:
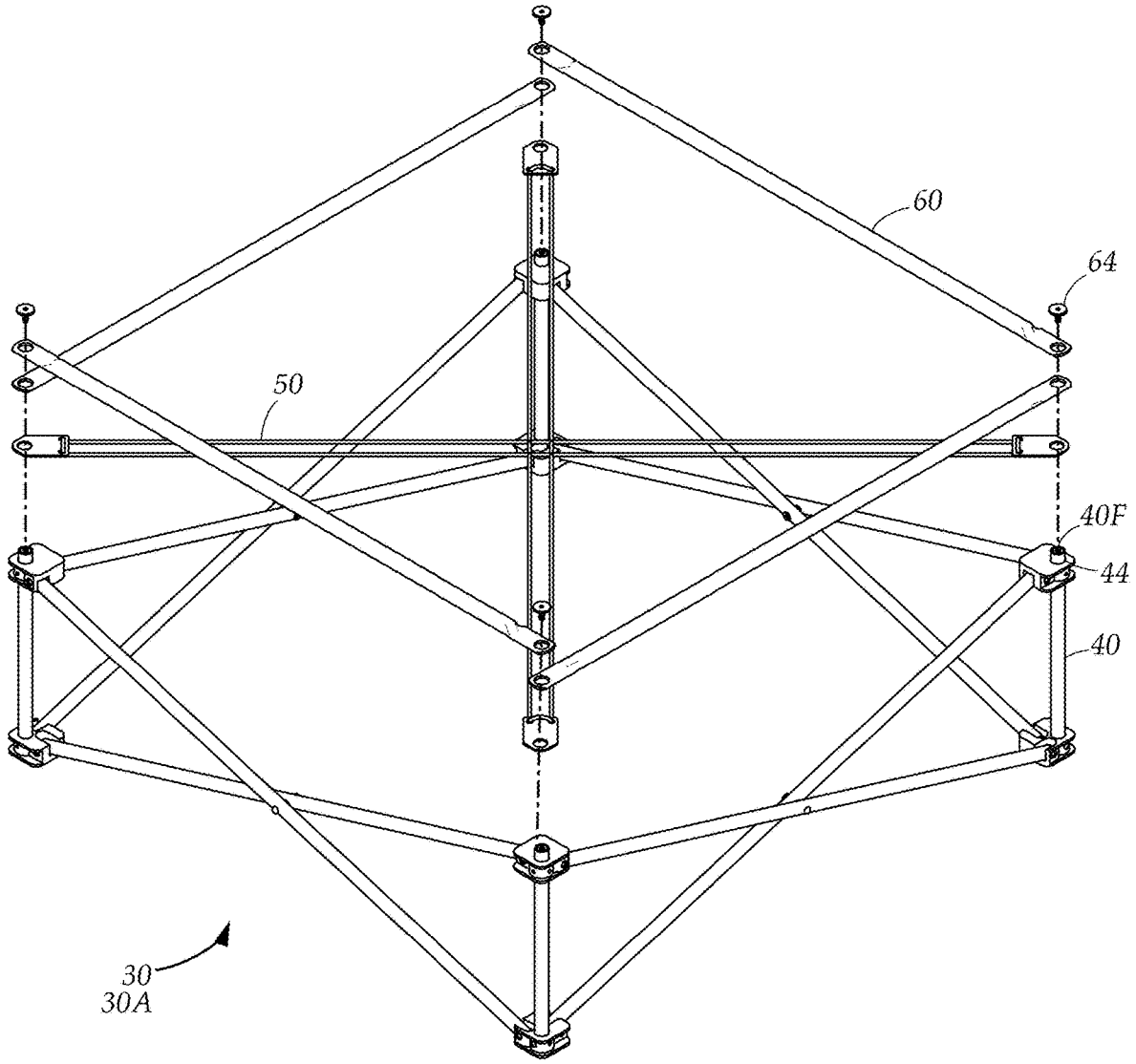
FIG. 15 is a diagrammatic perspective view, detailing the primary frame with braces and deck support assemblies, being fastened with four top screws to complete the ottoman seating module.

For additional clarity, hereinbelow, some variations of the primary frame 30 by way of the different seating modules are discussed in further detail. Note in the variations shown in FIG. 15, FIG. 17, and FIG. 18, the pad 70 (seen in other figures) is not shown. FIG. 15 shows the ottoman configuration 30A, FIG. 16 shows the corner configuration 30C, and FIG. 18 shows the armchair configuration 30D.

With the ottoman configuration 30A in FIG. 15, all vertical masts 40 have the short protrusion at their free end 40F. Accordingly, after the deck supports 50 and bars 60 are in position, top screws 64 may be secured into the free end 40F at all four corners 31.

Figure 16:
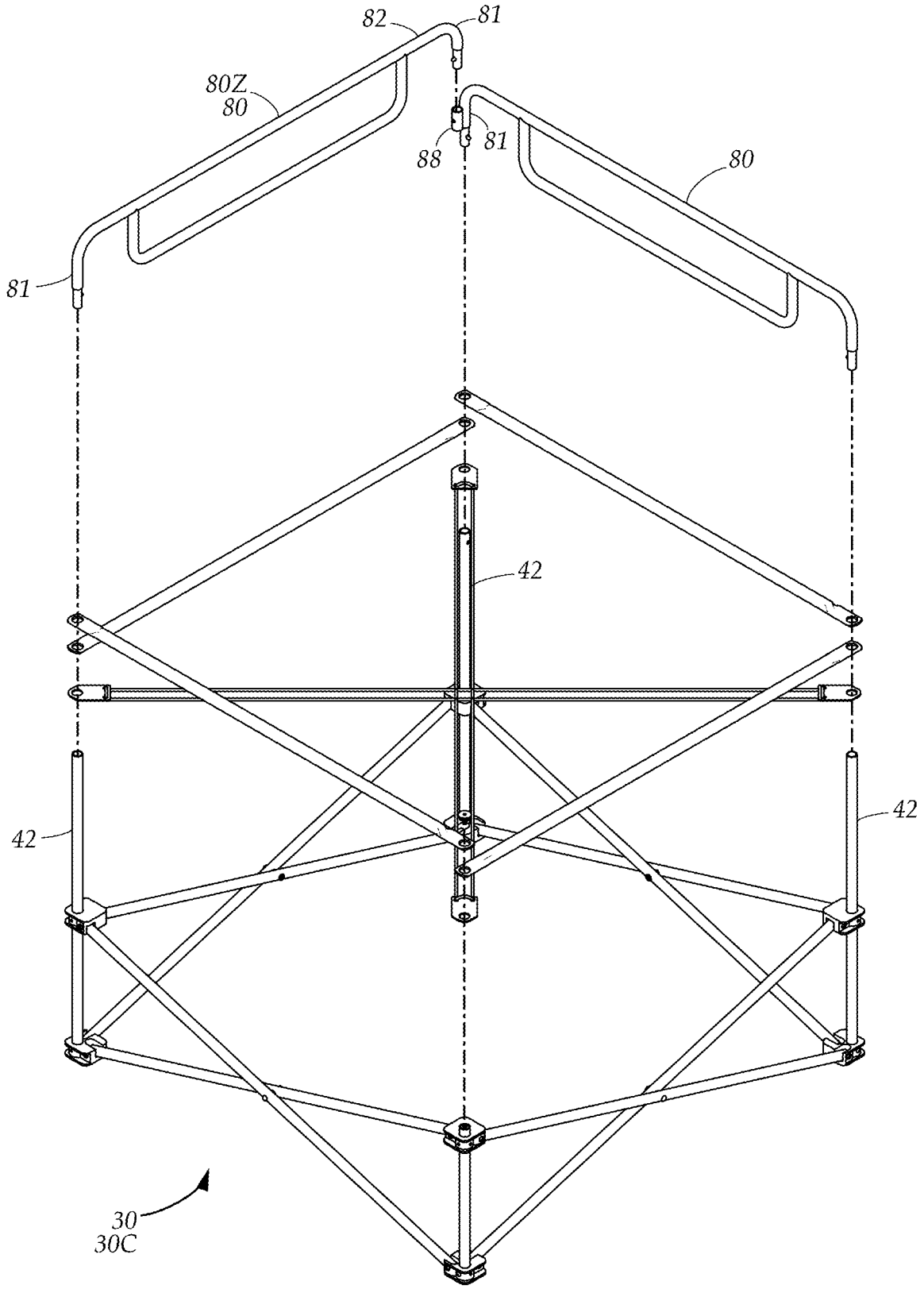
FIG. 16 is a diagrammatic perspective view, illustrating a pair of cross bars being connected together and secured to three extended uprights to create a corner seating unit.
Figure 17:
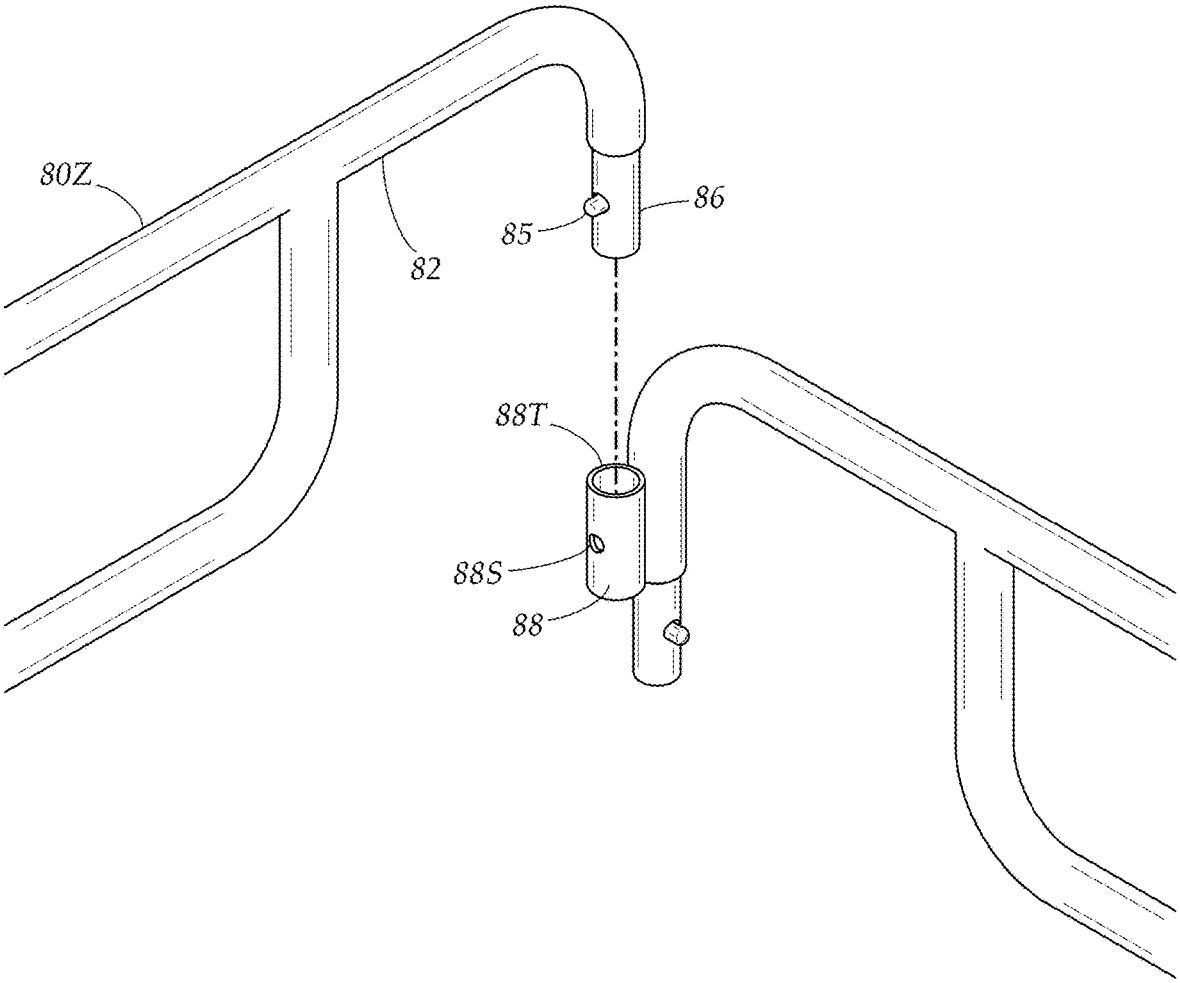
FIG. 17 is an enlarged diagrammatic perspective view, detailing interconnection of the cross bars, by attaching the short bar of one of the cross bars into the attachment sleeve of the other cross bar.

With the corner configuration 30C of FIG. 16, three extended uprights 42 are present to mate with two cross bars 80. To facilitate attachment of the cross bars 80 where they meet at a common extended upright 42, the cross bar 80 has an attachment sleeve 88 on one or both of its vertical arms 81. As seen in FIG. 17, the attachment sleeve 88 has a top opening 88T and a side opening 88S. Accordingly, the plug 86 of a secondary cross bar 802 can thereby extend into the top opening 88T of the attachment sleeve 88, whereby the detent pin 85 pops into the side opening 88S of the attachment sleeve 88. To properly fit the frame 30 (see FIG. 16), the horizontal leg 82 of the secondary cross bar 802 is slightly shorter than in the versions previously described. And to fit into the attachment sleeve, the vertical leg 81 is shorter than the other vertical leg 81 on that same secondary cross bar 802.

Figure 18:
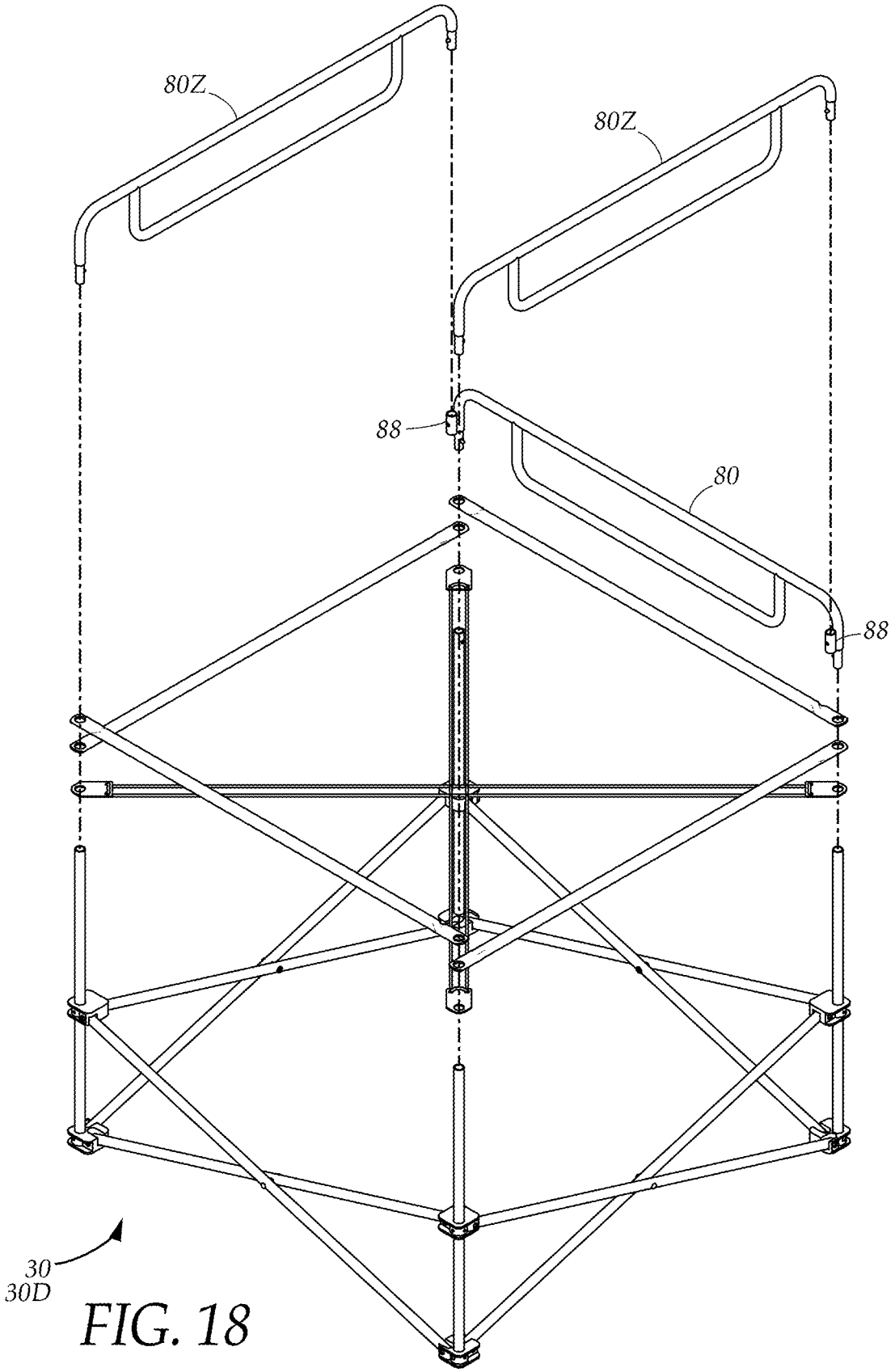
FIG. 18 is an enlarged diagrammatic perspective view, wherein three cross bars are attached to the vertical masts and attached to each other to create an armchair seating unit.

In the armchair configuration 30D of FIG. 18, the cross bar 80 must have two attachment sleeves 88, one on each vertical arm 81, to accommodate two secondary cross bars that must mate with it. Each of the secondary cross bars 802 have one of its vertical legs 81 shortened, and its horizontal leg shortened 81 to fit within the attachment sleeves 88 and to fit the geometry of the frame 30.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a modular seating unit that is easily assembled, and is fully machine washable. The disclosure is illustrated by example in the drawing figures, and throughout the written description. It should be understood that numerous variations are possible, while adhering to the inventive concept. Such variations are contemplated as being a part of the present disclosure.

What is claimed is:

1. A seating module, comprising:

a primary frame having a rectangular footprint with four corners, with four upper attachment connectors and four lower attachment connectors at the corners, and four vertical masts, each vertical mast having a free end and a fixed end that is attached in one of the lower vertical connectors, the primary frame further having four pairs of horizontal members, the horizontal members of each pair of horizontal members are pivotally joined midway in a scissor arrangement, and each pair of horizontal members extends between one of the corners and another of the corners adjacent to said corner, one of the horizontal members of said pair extending between the upper attachment connector of said one of the corners and the lower attachment connector of the corner adjacent to said corner, the other of the horizontal members of said pair extending between the lower attachment connector of said one of the corners and the upper attachment connector of the corner adjacent to said corner;

wherein said horizontal members are pivotally connected to the upper and lower attachment connectors such that the rectangular footprint is expandable from a folded position to a deployed position, each of the upper attachment connectors have a vertical bore such that as the frame is moved from the folded position into the deployed position, the vertical masts at each corner extend into the vertical bore of the upper attachment connector at that corner;

four brace bars, each brace bar extending horizontally between the upper attachment connector at one of the corners and the upper attachment connector at an adjacent corner;

a deck pad, rectangular in shape, having four side edges and four corners that correspond with the upper attachment connectors, the deck pad secured to the brace bars along the side edges of the deck pad;

a duvet cover, made of fabric, extending over the deck pad and having lower sides that extend downwardly from the side edges of the deck pad to the lower attachment connectors to cover the vertical masts and horizontal members;

a decorative cover, made of fabric, for covering the duvet cover; and at least one cushion, resting on top of the deck pad.

2. The first seating module as described in claim 1, wherein the brace bars have a pair of flattened ends that each have a mounting hole, the upper attachment connectors each have a top surface and a bottom surface, the vertical bore of each of said connectors extend from the bottom surface to the top surface, wherein the vertical masts extend into the vertical bore through the bottom surface of the upper attachment connectors and extend beyond the top surface, and wherein the flattened end of each brace bar rests upon the top surface of the upper attachment connectors and the vertical masts extend through said mounting holes.

3. The seating module as described in claim 2, further comprising a pair of deck supports, each deck support having a pair of deck support plates that each have a mounting opening and a cable loop that extends between the deck support plates, each deck support extending diagonally between the upper attachment connectors at opposite corners where the vertical masts extend through the mounting openings of the deck support plates.

4. The seating module as described in claim 3, wherein two of the vertical masts have an extended upright that extends significantly above the top surface of its associated upper attachment connector, each extended upright has a top opening and a side opening near the top opening, and further comprising a cross bar, the cross bar having a two vertical legs and a horizontal leg extending between the vertical leg, the two vertical legs each having a plug that is sized to fit within the top opening and having a detent pin on the plug, the two vertical legs extending into the top opening until the detent pin pops out through the side opening to secure the cross bar to the vertical masts.

5. The seating module as described in claim 3, wherein vertical masts have an extended upright that extends significantly above the top surface of its associated upper attachment connector, each extended upright has a top opening and a side opening near the top opening, and further comprising a cross bar and two secondary cross bars, the cross bar having a two vertical legs and a horizontal leg extending between the vertical leg, the two vertical legs each having a plug that is sized to fit within the top opening and having a detent pin on the plug, the two vertical legs extending into the top opening of two adjacent vertical masts until the detent pin pops out through the side opening to secure the cross bar to the vertical masts, the cross bar having an attachment sleeve located on each of its vertical legs, each of said attachment sleeves having a top opening and a side opening, each of the secondary cross bars having a pair of vertical legs and one of said vertical legs has a plug having a detent pin, said vertical leg of each of said secondary cross bars extending into one of the attachment sleeves of the cross bar.

6. A seating module, comprising:

a primary frame having a rectangular footprint with four corners, with four upper attachment connectors having a top surface at the corners, four lower attachment connectors at the corners, and four vertical masts, each vertical mast having a free end and a fixed end that is attached in one of the lower vertical connectors, the primary frame further having four pairs of horizontal members, the horizontal members of each pair of horizontal members are pivotally joined midway in a scissor arrangement, and each pair of horizontal members extends between the upper and lower attachment connectors at two adjacent corners;

wherein said horizontal members are pivotally connected to the upper and lower attachment connectors such that the rectangular footprint is expandable from a folded position to a deployed position, each of the upper attachment connectors have a vertical bore such that as the frame is moved from the folded position into the deployed position, the vertical masts at each corner extend through the vertical bore of the upper attachment connector at that corner and above the top surface of said upper attachment connector;

four brace bars, each brace bar having a flattened end with a mounting hole and extending horizontally between the upper attachment connector at one of the corners and the upper attachment connector at an adjacent corner, with the vertical masts at each upper attachment connector extending vertically through the mounting holes;

a pair of deck supports, each deck support having a pair of deck support plates that each have a mounting opening and a cable loop that extends between the deck support plates, each deck support extending diagonally between the upper attachment connectors at opposite corners where the vertical masts extend through the mounting openings of the deck support plates;

a deck pad, rectangular in shape, having a bottom surface, four side edges and four corners that correspond with the upper attachment connectors, the deck pad secured to the brace bars along the side edges of the deck pad by a plurality securing straps that have a fixed end and a free end, the fixed end of each strap extending along the bottom of the deck pad, the free end extending around the bar and securing to the fixed end.

7. The seating unit as recited in claim 6, further comprising:

a duvet cover, made of fabric, extending over the deck pad and having lower sides that extend downwardly from the side edges of the deck pad to the lower attachment connectors to cover the vertical masts and horizontal members;

a decorative cover, made of fabric, for covering the duvet cover; and at least one cushion, resting on top of the deck pad.

8. The seating module as described in claim 7, wherein two of the vertical masts have an extended upright that extends significantly above the top surface of its associated upper attachment connector, each extended upright has a top opening and a side opening near the top opening, and further comprising a cross bar, the cross bar having a two vertical legs and a horizontal leg extending between the vertical leg, the two vertical legs each having a plug that is sized to fit within the top opening and having a detent pin on the plug, the two vertical legs extending into the top opening until the detent pin pops out through the side opening to secure the cross bar to the vertical masts.

* * * * *